US010453419B2

(12) United States Patent
Sung et al.

(10) Patent No.: US 10,453,419 B2
(45) Date of Patent: Oct. 22, 2019

(54) DISPLAY PANEL DRIVING APPARATUS, A METHOD OF DRIVING A DISPLAY PANEL USING THE DISPLAY PANEL DRIVING APPARATUS AND A DISPLAY APPARATUS HAVING THE DISPLAY PANEL DRIVING APPARATUS

(71) Applicant: SAMSUNG DISPLAY CO., LTD., Yongin-si, Gyeonggi-Do (KR)

(72) Inventors: Jeong-Min Sung, Seoul (KR); Byung-Kil Jeon, Hwaseong-si (KR); Dong-Hyun Yeo, Yongin-si (KR); Su-Hyun Jeong, Gwangju-si (KR); Eun-Seon Kim, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/968,085

(22) Filed: May 1, 2018

(65) Prior Publication Data

US 2018/0247606 A1 Aug. 30, 2018

Related U.S. Application Data

(63) Continuation of application No. 15/093,087, filed on Apr. 7, 2016, now abandoned.

(30) Foreign Application Priority Data

Sep. 22, 2015 (KR) ..... 10-2015-0133888

(51) Int. Cl.
*G09G 3/36* (2006.01)

(52) U.S. Cl.
CPC ..... *G09G 3/3696* (2013.01); *G09G 3/3611* (2013.01); *G09G 2320/0252* (2013.01);
(Continued)

(58) Field of Classification Search
CPC ..... G09G 3/3696; G09G 2320/041
See application file for complete search history.

(56) References Cited

U.S. PATENT DOCUMENTS

2008/0238340 A1* 10/2008 Leung ..... H05B 33/0827 315/297
2009/0021507 A1 1/2009 Bae et al.
(Continued)

OTHER PUBLICATIONS

Office Action dated Aug. 15, 2017 in corresponding U.S. Appl. No. 15/093,087.
(Continued)

*Primary Examiner* — Yuzhen Shen
(74) *Attorney, Agent, or Firm* — F. Chau & Associates, LLC

(57) ABSTRACT

A display panel driving apparatus includes a gate driving circuit, a data driving circuit, a timing controlling circuit and a voltage generating circuit state receiving circuit. The voltage generating circuit state receiving circuit is configured to receive voltage generating circuit state data indicating a temperature, a voltage or a current of a voltage generating circuit from the voltage generating circuit. The voltage generator generates a voltage used to drive the display panel, and controls an operation of the timing controlling circuit according to the voltage generating circuit state data.

16 Claims, 18 Drawing Sheets

(52) U.S. Cl.
CPC ... *G09G 2320/041* (2013.01); *G09G 2330/12* (2013.01); *G09G 2340/16* (2013.01)

(56) References Cited

U.S. PATENT DOCUMENTS

| | | | | |
|---|---|---|---|---|
| 2009/0021669 | A1* | 1/2009 | Lee ..... | G09G 3/3648 349/72 |
| 2010/0220088 | A1 | 9/2010 | Kim | |
| 2011/0025676 | A1 | 2/2011 | Kawashima | |
| 2013/0120233 | A1 | 5/2013 | Jeon et al. | |
| 2013/0176353 | A1 | 7/2013 | Park et al. | |
| 2017/0084244 | A1 | 3/2017 | Sung et al. | |

OTHER PUBLICATIONS

Final Office Action dated Dec. 1, 2017 in corresponding U.S. Appl. No. 15/093,087.

* cited by examiner

DISPLAY PANEL DRIVING APPARATUS, A METHOD OF DRIVING A DISPLAY PANEL USING THE DISPLAY PANEL DRIVING APPARATUS AND A DISPLAY APPARATUS HAVING THE DISPLAY PANEL DRIVING APPARATUS

CROSS-REFERENCE TO RELATED APPLICATIONS

This application is a continuation application of U.S. patent application Ser. No. 15/093,087, filed Apr. 7, 2016, which claims priority under 35 U.S.C. § 119 to Korean Patent Application No. 10-2015-0133888, filed on Sep. 22, 2015 in the Korean Intellectual Property Office (KIPO), the disclosures of which are incorporated by reference herein in their entireties.

TECHNICAL FIELD

Exemplary embodiments of the present inventive concept relate to a display panel driving apparatus, a method of driving a display panel using the display panel driving apparatus, and a display apparatus having the display panel driving apparatus.

DISCUSSION OF RELATED ART

In general, a display apparatus includes a display panel, a gate driving part, a data driving part, a timing controlling part and a voltage generating part.

The display panel displays an image, and includes a plurality of gate lines and a plurality of data lines. The gate driving part outputs a gate signal to at least one of the gate lines. The data driving part outputs a data signal to at least one of the data lines. The timing controlling part controls timings of the gate driving part and the data driving part. The voltage generating part generates a voltage used to drive the display panel and outputs the voltage to the display panel, the gate driving part and the data driving part.

However, when the voltage generating part operates abnormally during the driving of the display panel the display quality of an image displayed on the display panel may be degraded. In addition, the gate driving part, the data driving part and the timing controlling part in the display apparatus may be damaged.

SUMMARY

According to an exemplary embodiment of the present inventive concept, a display panel driving apparatus includes a gate driving circuit, a data driving circuit, a timing controlling circuit and a voltage generating circuit state receiving circuit. The gate driving circuit is configured to output a gate signal to a gate line of a display panel that displays an image. The data driving circuit is configured to output a data signal to a data line of the display panel. The timing controlling circuit is configured to control timings of the gate driving circuit and the data driving circuit. The voltage generating circuit state receiving circuit is configured to receive voltage generating circuit state data indicating a temperature, a voltage or a current of a voltage generating circuit from the voltage generating circuit which generates a voltage to drive the display panel, and controls an operation of the timing controlling circuit according to the voltage generating circuit state data.

In an exemplary embodiment of the present inventive concept, the voltage generating circuit state receiving circuit may receive a voltage generating circuit temperature data indicating the temperature of the voltage generating circuit from the voltage generating circuit. The voltage generating circuit state receiving circuit may output a Dynamic Capacitance Compensation (DCC) value selection signal for selecting a DCC value according to the voltage generating circuit temperature data.

In an exemplary embodiment of the present inventive concept, the voltage generating circuit state receiving circuit may receive a voltage generating circuit temperature data indicating the temperature of the voltage generating circuit from the voltage generating circuit. The voltage generating circuit state receiving circuit may output an Accurate Color Capture (ACC) compensation value selection signal for selecting an ACC compensation value according to the voltage generating circuit temperature data.

In an exemplary embodiment of the present inventive concept, the voltage generating circuit state receiving circuit may receive a voltage generating circuit voltage data indicating the voltage of the voltage generating circuit from the voltage generating circuit. The voltage generating circuit state receiving circuit may output a ready signal control signal for controlling a ready signal of the timing controlling circuit according to the voltage of the voltage generating circuit.

In an exemplary embodiment of the present inventive concept, when the voltage is less than a reference voltage, the timing controlling circuit may activate the ready signal according to the ready signal control signal, and when the voltage of the voltage generating circuit is not less than the reference voltage, the timing controlling circuit may deactivate the ready signal according to the ready signal control signal.

In an exemplary embodiment of the present inventive concept, the voltage generating circuit state receiving circuit may receive a voltage generating circuit voltage data indicating the voltage of the voltage generating circuit from the voltage generating circuit. The voltage generating circuit state receiving circuit may output a data output control signal for controlling an output data from the timing controlling circuit according to the voltage of the voltage generating circuit.

In an exemplary embodiment of the present inventive concept, when the voltage of the voltage generating circuit is less than a reference voltage, the timing controlling circuit may output an image data according to the data output control signal, and when the voltage of the voltage generating circuit is not less than the reference voltage, the timing controlling circuit may output a built in self test data according to the data output control signal.

In an exemplary embodiment of the present inventive concept, the voltage generating circuit state receiving circuit may receive voltage generating circuit current data indicating the current of the voltage generating circuit from the voltage generating circuit. The voltage generating circuit state receiving circuit may output a ready signal control signal for controlling a ready signal of the timing controlling circuit according to the current of the voltage generating circuit.

In an exemplary embodiment of the present inventive concept, when the current of the voltage generating circuit is less than a reference current, the timing controlling circuit may activate the ready signal according to the ready signal control signal, and when the current of the voltage generating circuit is not less than the reference current, the timing controlling circuit may deactivate the ready signal according to the ready signal control signal.

In an exemplary embodiment of the present inventive concept, the voltage generating circuit state receiving circuit may receive a voltage generating circuit current data indicating the current of the voltage generating circuit from the voltage generating circuit. The voltage generating circuit state receiving circuit may output a data output control signal for controlling output data of the timing controlling circuit according to the current of the voltage generating circuit.

In an exemplary embodiment of the present inventive concept, when the current of the voltage generating circuit is less than a reference current, the timing controlling circuit may output an image data according to the data output control signal, and when the current of the voltage generating circuit is not less than the reference current, the timing controlling circuit may output built in self test data according to the data output control signal.

According to an exemplary embodiment of the present inventive concept, a method of driving a display panel includes receiving voltage generating circuit state data indicating a temperature, a voltage or a current of a voltage generating circuit from the voltage generating circuit. The voltage generating circuit generates a first voltage used for driving the display panel. A timing control circuit control signal for controlling an operation of a timing controlling circuit according to the voltage generating circuit state data is output. The timing controlling circuit is operated according to the timing controlling circuit control signal. A data signal is output to a data line of the display panel according to an operation of the timing controlling circuit. A gate signal is output to a gate line of the display panel according to the operation of the timing controlling circuit.

In an exemplary embodiment of the present inventive concept, the receiving of the voltage generating circuit state data may include receiving a voltage generating circuit temperature data indicating the temperature of the voltage generating circuit. The outputting of the timing control circuit control signal may include outputting a Dynamic Capacitance Compensation (DCC) value selection signal for selecting a DCC value according to the voltage generating circuit temperature data.

In an exemplary embodiment of the present inventive concept, receiving the voltage generating circuit state data may include receiving voltage generating circuit temperature data indicating the temperature of the voltage generating circuit, and the outputting the timing control circuit control signal may include outputting an Accurate Color Capture (ACC) compensation value selection signal for selecting an ACC compensation value according to the voltage generating circuit temperature data.

In an exemplary embodiment of the present inventive concept, receiving the voltage generating circuit state data may include receiving voltage generating circuit voltage data indicating the voltage of the voltage generating circuit. The timing control circuit control signal may include outputting a ready signal control signal for controlling a ready signal of the timing controlling circuit outputs according to the voltage of the voltage generating circuit. When the voltage of the voltage generating circuit is less than a reference voltage, the timing controlling circuit may activate the ready signal according to the ready signal control signal, and when the voltage of the voltage generating circuit is not less than the reference voltage, the timing controlling circuit may deactivate the ready signal according to the ready signal control signal.

In an exemplary embodiment of the present inventive concept, receiving the voltage generating circuit state data may include receiving voltage generating circuit voltage data indicating the voltage of the voltage generating circuit. The timing control circuit control signal may include outputting a data output control signal for controlling output data of the timing controlling circuit according to the voltage of the voltage generating circuit. When the voltage of the voltage generating circuit is less than a reference voltage, the timing controlling circuit may output image data according to the data output control signal, and when the voltage of the voltage generating circuit is not less than the reference voltage, the timing controlling circuit may output built in self test data according to the data output control signal.

In an exemplary embodiment of the present inventive concept, the receiving the voltage generating circuit state data may include receiving voltage generating circuit current data indicating the current of the voltage generating circuit. The timing control circuit control signal may include outputting a ready signal control signal for controlling a ready signal of the timing controlling circuit outputs according to the current of the voltage generating circuit. When the current of the voltage generating circuit is less than a reference current, the timing controlling circuit may activate the ready signal according to the ready signal control signal, and when the current of the voltage generating circuit is not less than the reference current, the timing controlling circuit may deactivate the ready signal according to the ready signal control signal.

In an exemplary embodiment of the present inventive concept, the receiving the voltage generating circuit state data may include receiving voltage generating circuit current data indicating the current of the voltage generating circuit. The timing control circuit control signal may include outputting a data output control signal for controlling output data of the timing controlling circuit outputs according to the current of the voltage generating circuit. When the current of the voltage generating circuit is less than a reference current, the timing controlling circuit may output image data according to the data output control signal, and when the current of the voltage generating circuit is not less than the reference current, the timing controlling circuit may output built in self test data according to the data output control signal, According to an exemplary embodiment of the present inventive concept, a display apparatus includes a display panel and a display panel driving apparatus. The display panel is configured to display an image and includes a gate line and a data line. The display panel driving apparatus includes a gate driving circuit configured to output a gate signal to the gate line of the display panel, a data driving circuit configured to output a data signal to the data line of the display panel, a timing controlling circuit configured to control timings of the gate driving circuit and the data driving circuit, and a voltage generating circuit state receiving circuit configured to receive voltage generating circuit state data indicating a temperature, a voltage or a current of a voltage generating circuit from the voltage generating circuit. The voltage generating circuit generates a first voltage to drive the display panel, and controls an operation of the timing controlling circuit according to the voltage generating circuit state data.

In an exemplary embodiment of the present inventive concept, the voltage generating circuit state receiving circuit may receive voltage generating circuit temperature data indicating the temperature of the voltage generating circuit, voltage generating circuit voltage data indicating the voltage of the voltage generating circuit, and voltage generating circuit current data indicating the current of the voltage generating circuit.

According to an exemplary embodiment of the present inventive concept, a display apparatus may include a display panel, a gate driver, a data driver, a voltage generator and a timing controller. The gate driver may output a gate signal to a gate line of the display panel. The data driver may output a data signal to a data line of the display panel. The voltage generator may generate a voltage to drive the display panel and generate a voltage generating circuit state data based on one or more parameters. The timing controller may control the timing of the gate driver and the data driver based on the voltage generating circuit state data.

In an exemplary embodiment of the present inventive concept, the voltage generator may include a measuring device to measure a voltage output from the voltage generator, a current output from the voltage generator or a temperature output from the voltage generator.

In an exemplary embodiment of the present inventive concept, the timing controller includes a voltage generator state receiving circuit that receives a parameter indicating the temperature of the voltage generator from the voltage generator. The voltage generator state receiving circuit outputs a Dynamic Capacitance Compensation (DCC) value selection signal for selecting a DCC value according to the parameter.

In an exemplary embodiment of the present inventive concept, the timing controller includes a voltage generator state receiving circuit that receives a parameter indicating the temperature of the voltage generator from the voltage generator. The voltage generator state receiving circuit outputs an Accurate Capacitance Capture (ACC) compensation value selection signal for selecting an ACC compensation value according to the parameter.

BRIEF DESCRIPTION OF THE DRAWINGS

The above and other features of the present inventive concept will become more apparent by describing in detail exemplary embodiments thereof with reference to the accompanying drawings, in which.

DETAILED DESCRIPTION OF THE EMBODIMENTS

Hereinafter, an exemplary embodiment of the present inventive concept will be explained in detail with reference to the accompanying drawings.

Figure 1:
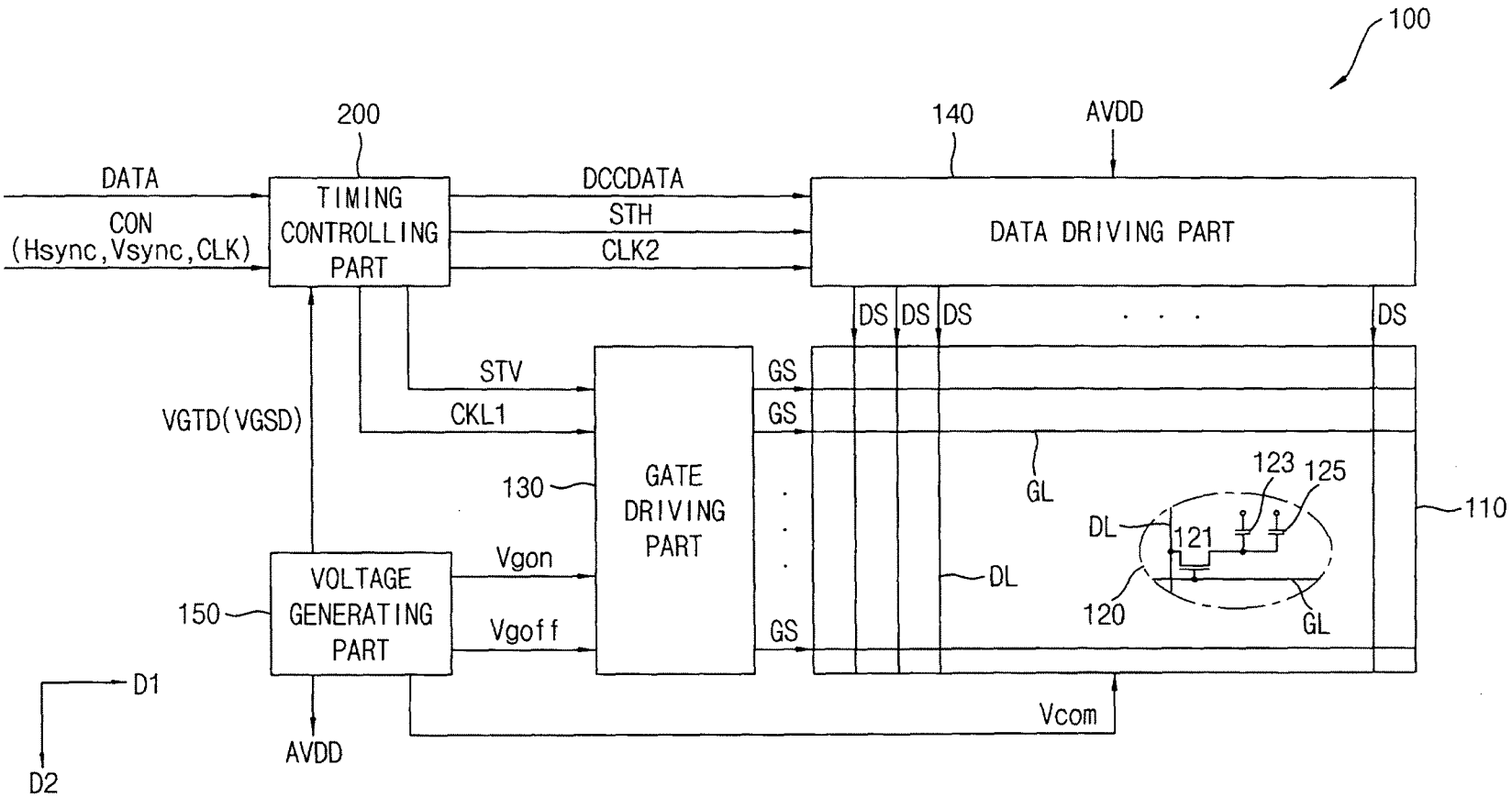
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, according to an exemplary embodiment of the present inventive concept the display apparatus 100 includes a display panel 110, a gate driving part 130, a data driving part 140, a voltage generating part 150 and a timing controlling part 200. The gate driving part 130, the data driving part 140, the voltage generating part 150 and the timing controlling part 200 are used to drive the display panel 110, and thus the gate driving part 130, the data driving part 140, the voltage generating part 150 and the timing controlling part 200 may be referred to as a display panel driving apparatus.

The display panel 110 receives a data signal DS to display an image. The display panel 110 includes gate lines GL, data lines DL and a plurality of pixels 120. The gate lines GL extend in a first direction D1 and are arranged in a second direction D2 substantially perpendicular to the first direction D1. The data lines DL extend in the second direction D2 and are arranged in the first direction D1. Each of the pixels 120 includes a thin film transistor 121 electrically connected to the gate line GL and the data line DL, a liquid crystal capacitor 123 and a storage capacitor 125 connected to the thin film transistor 121. Thus, the display panel 110 may be a liquid crystal display panel.

The gate driving part 130 generates a gate signal GS in response to a vertical start signal STV and a first clock signal CLK1 provided from the timing controlling part 200, and outputs the gate signal GS to the gate line GL.

The data driving part 140 outputs the data signals DS based on Dynamic Capacitance Compensation (DCC) image data DCCDATA provided from the timing controlling part 200 to the data line DL in response to a horizontal start signal STH and a second clock signal CLK2 provided from the timing controlling part 200.

The voltage generating part 150 generates and outputs a voltage used in a driving of the display panel 110. The voltage generating part 150 may generate a gate on voltage Vgon and a gate off voltage Vgoff and may output the gate on voltage Vgon and the gate off voltage Vgoff to the gate driving part 130. The voltage generating part 150 may generate and output an analog driving voltage AVDD to the data driving part 140. The voltage generating part 150 may generate a common voltage Vcom and may output the common voltage Vcom to the display panel 110. For example, the voltage generating part 150 may be a Power Management Integrated Circuit (PMIC).

The voltage generating part 150 may include a measuring device for tracking a plurality of parameters. The measuring device may measure one or more of a voltage, current and temperature output from the voltage generating part 150.

The timing controlling part 200 receives the image data DATA and a control signal CON from an outside source. The control signal CON may include a horizontal synchronous signal Hsync, a vertical synchronous signal Vsync and a clock signal CLK. The timing controlling part 200 generates the horizontal start signal STH using the horizontal synchronous signal Hsync and outputs the horizontal start signal STH to the data driving part 140. The timing controlling part 200 generates the vertical start signal STV using the vertical synchronous signal Vsync and outputs the vertical start signal STV to the gate driving part 130. In addition, the timing controlling part 200 generates the first clock signal CLK1 and the second clock signal CLK2 using the clock signal CLK, outputs the first clock signal CLK1 to the gate driving part 130, and outputs the second clock signal CLK2 to the data driving part 140.

The timing controlling part 200 receives voltage generating part state data VGSD indicating a state of the voltage generating part 150. For example, the timing controlling part 200 may receive voltage generating part temperature data VGTD indicating a temperature of the voltage generating part 150.

The timing controlling part 200 may perform a Dynamic Capacitance Compensation (DCC) according to the voltage generating part temperature data VGTD on the image data DATA and may output the DCC image data.

The term "part", as used herein, means, but is not limited to, a software or hardware component, such as a field programmable gate array (FPGA) or an application specific integrated circuit (ASIC), which performs certain tasks. A part may advantageously be configured to reside in the addressable storage medium and configured to execute on one or more processors. Thus, a part may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and parts may be combined into fewer components and modules or further separated into additional components and modules.

Figure 2:
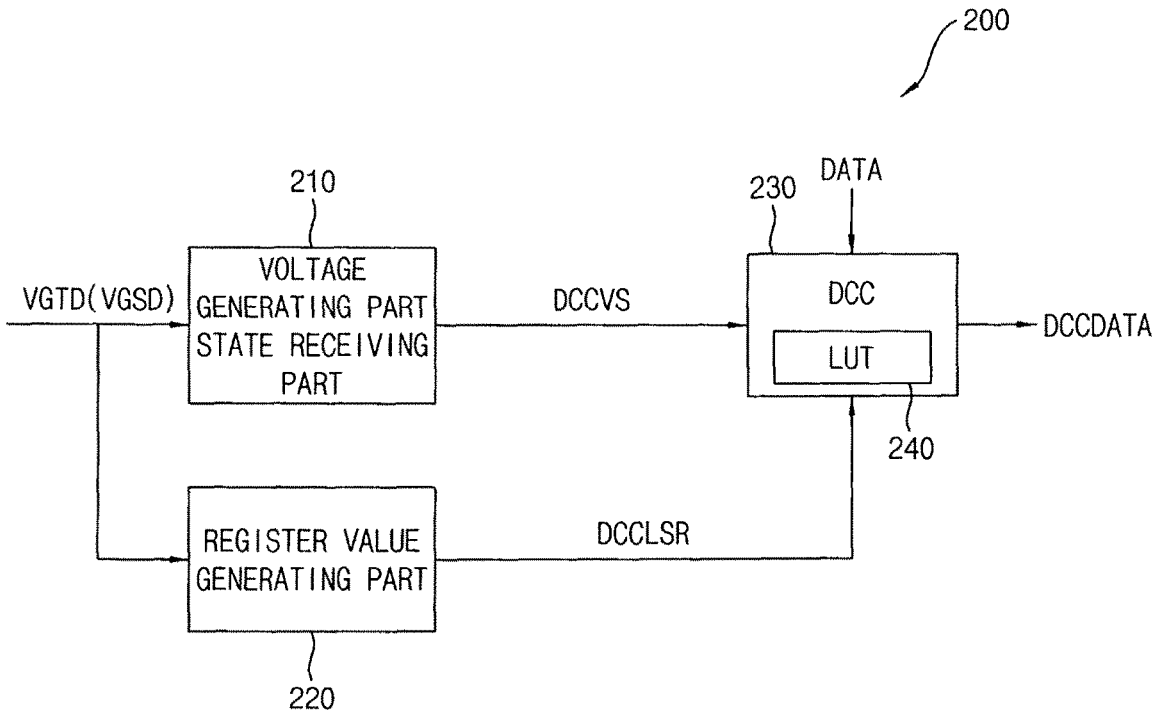
FIG. 2 is a block diagram illustrating a timing controlling part of FIG. 1 according to an exemplary embodiment of the present inventive concept.

FIG. 2 is a block diagram illustrating the timing controlling part 200 of FIG. 1 according to an exemplary embodiment of the present inventive concept.

Referring to FIGS. 1 and 2, the timing controlling part 200 includes a voltage generating part state receiving part 210, a register value generating part 220 and a dynamic capacitance compensating part 230.

The voltage generating part state receiving part 210 receives, from the voltage generating part 150, the voltage generating part temperature data VGTD. The voltage generating part temperature data VGTD indicates the temperature of the voltage generating part 150. The voltage generating part temperature data VGTD may be included among pieces of the voltage generating part state data VGSD indicating the state of the voltage generating part 150. For example, the voltage generating part state receiving part 210 may receive the voltage generating part temperature data VGTD from the voltage generating part 150 through an Inter-Integrated Circuit (I2C) communication. The voltage generating part state receiving part 210 outputs a DCC value selection signal DCCVS to the dynamic capacitance compensating part 230 according to the voltage generating part temperature data VGTD. The DCC value selection signal DCCVS controls an operation of the timing controlling part 200, and thus the DCC value selection signal DCCVS may be a timing controlling part control signal.

The register value generating part 220 receives the voltage generating part temperature data VGTD from the voltage generating part 150 and outputs a DCC look-up table selection register value DCCLSR to the dynamic capacitance compensating part 230 according to the voltage generating part temperature data VGTD.

The dynamic capacitance compensating part 230 includes a DCC look-up table 240. The dynamic capacitance compensating part 230 selects a DCC value in the DCC look-up table 240 according to the DCC value selection signal DCCVS. The dynamic capacitance compensating part 230 performs the DCC on the image data DATA using the DCC value, and outputs the DCC image data DCCDATA. The dynamic capacitance compensating part 230 may include a plurality of DCC look-up tables 240. In this case, the dynamic capacitance compensating part 230 may select one DCC look-up table 240 of the DCC look-up tables 240 according to the DCC look-up table selection register value DCCLSR.

When the temperature of the voltage generating part 150 is not less than a reference temperature, the voltage generating part state receiving part 210 may output a DCC value selection signal DCCVS according to the voltage generating part temperature data VGTD. The DCC value selection signal DCCVS indicates a DCC value which is used to prevent degradation of display quality of an image displayed on the display panel 110. The dynamic capacitance compensating part 230 may perform the DCC on the image data DATA using the DCC value for preventing degradation of display quality of the image, according to the DCC value selection signal DCCVS, and may output the DCC image data DCCDATA.

Figure 3:
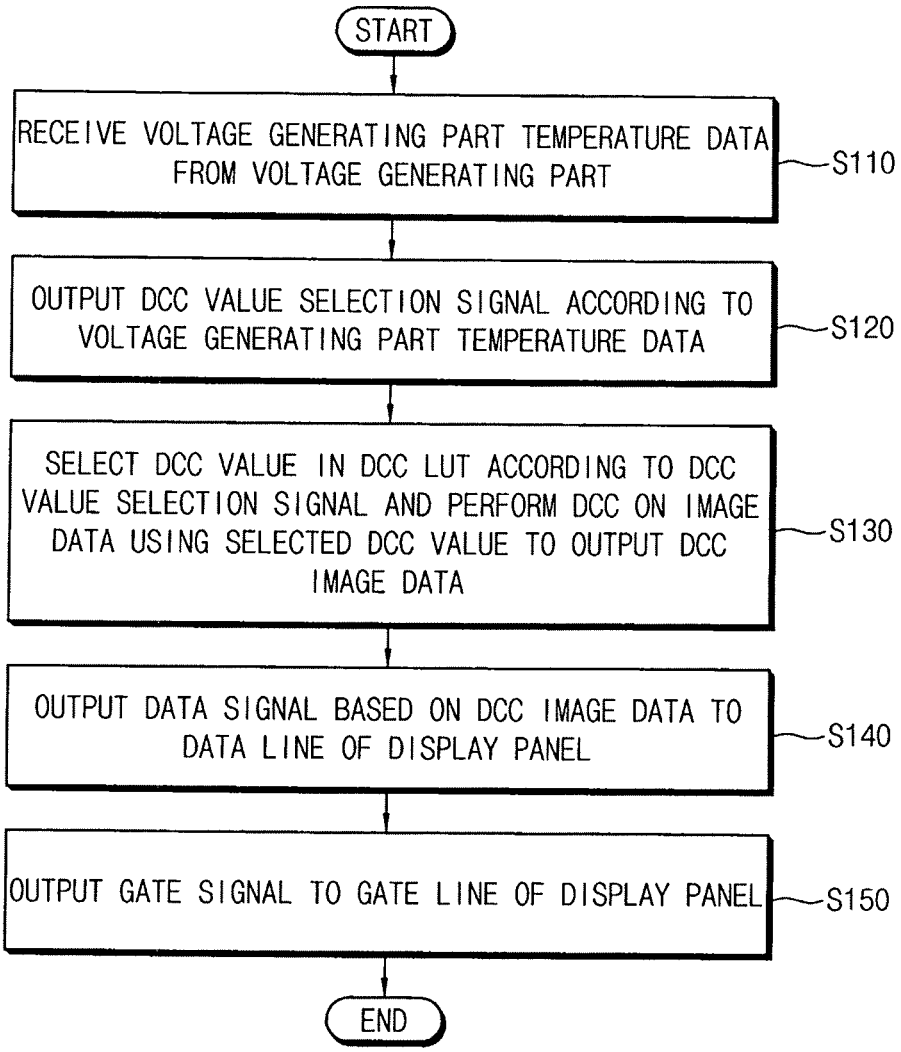
FIG. 3 is a flow chart illustrating a method of driving a display panel, using a display panel driving apparatus of FIG. 1 according to an exemplary embodiment of the present inventive concept.

FIG. 3 is a flow chart illustrating a method of driving a display panel, using the display panel driving apparatus of FIG. 1 according to an exemplary embodiment of the present inventive concept.

Referring to FIGS. 1 to 3, the voltage generating part temperature data VGTD is received from the voltage generating part 150 (step S110). The voltage generating part state receiving part 210 receives, from the voltage generating part 150, the voltage generating part temperature data VGTD indicating the temperature of the voltage generating part 150, among the pieces of the voltage generating part state data VGSD indicating the state of the voltage generating part 150. For example, the voltage generating part state receiving part 210 may receive the voltage generating part temperature data VGTD from the voltage generating part 150 through the I2C communication.

The DCC value selection signal DCCVS is output according to the voltage generating part temperature data VGTD (step S120). The voltage generating part state receiving part 210 outputs the DCC value selection signal DCCVS to the dynamic capacitance compensating part 230 according to the voltage generating part temperature data VGTD. When the temperature of the voltage generating part 150 is not less than the reference temperature, the voltage generating part state receiving part 210 may output the DCC value selection signal DCCVS according to the voltage generating part temperature data VGTD for selecting the DCC value to prevent degradation of the display quality of the image displayed on the display panel 110. The DCC value selection signal DCCVS controls the operation of the timing controlling part 200, and thus the DCC value selection signal DCCVS may be the timing controlling part control signal.

The DCC value is selected in the DCC look-up table 240 according to the DCC value selection signal DCCVS. The DCC performed on the image data DATA is based on the DCC value, and the DCC image data DCCDATA is output (step S130). The dynamic capacitance compensating part 230 includes the DCC look-up table 240. The dynamic capacitance compensating part 230 selects the DCC value in the DCC look-up table 240 according to the DCC value selection signal DCCVS. The dynamic capacitance compensating part 230 performs the DCC on the image data DATA using the DCC value, and outputs the DCC image data DCCDATA.

The data signal DS based on the DCC image data DCCDATA is output to the data line DL of the display panel 110 (step S140). The data driving part 140 outputs the data signals DS based on the DCC image data DCCDATA provided from the timing controlling part 200 to the data line DL in response to the horizontal start signal STH and the second clock signal CLK2 provided from the timing controlling part 200.

The gate signal GS is output to the gate line GL of the display panel 110 (step S150). The gate driving part 130 generates the gate signal GS in response to the vertical start signal STV and the first clock signal CLK1 provided from the timing controlling part 200, and outputs the gate signal GS to the gate line GL.

In an exemplary embodiment of the present inventive concept, the voltage generating part state receiving part 210, the register value generating part 220 and the dynamic capacitance compensating part 230 are disposed in the timing controlling part 200. However, the present inventive concept is not limited thereto. For example, the voltage generating part state receiving part 210, the register value generating part 220 and the dynamic capacitance compensating part 230 may be located outside the timing controlling part 200.

According to an exemplary embodiment of the present inventive concept, when the temperature of the voltage generating part 150 is not less than the reference temperature, the voltage generating part state receiving part 210 may output the DCC value selection signal DCCVS for selecting the DCC value. The DCC value selection signal DCCVS may be selected to prevent degradation of the display quality of an image displayed on the display panel 110, according to the voltage generating part temperature data VGTD. The dynamic capacitance compensating part 230 may perform the DCC on the image data DATA using the DCC value for preventing degradation of display quality of the image on the image data DATA, according to the DCC value selection signal DCCVS, and may output the DCC data DCCDATA. Thus, degradation of the display quality of the display apparatus 100 may be prevented.

Figure 4:
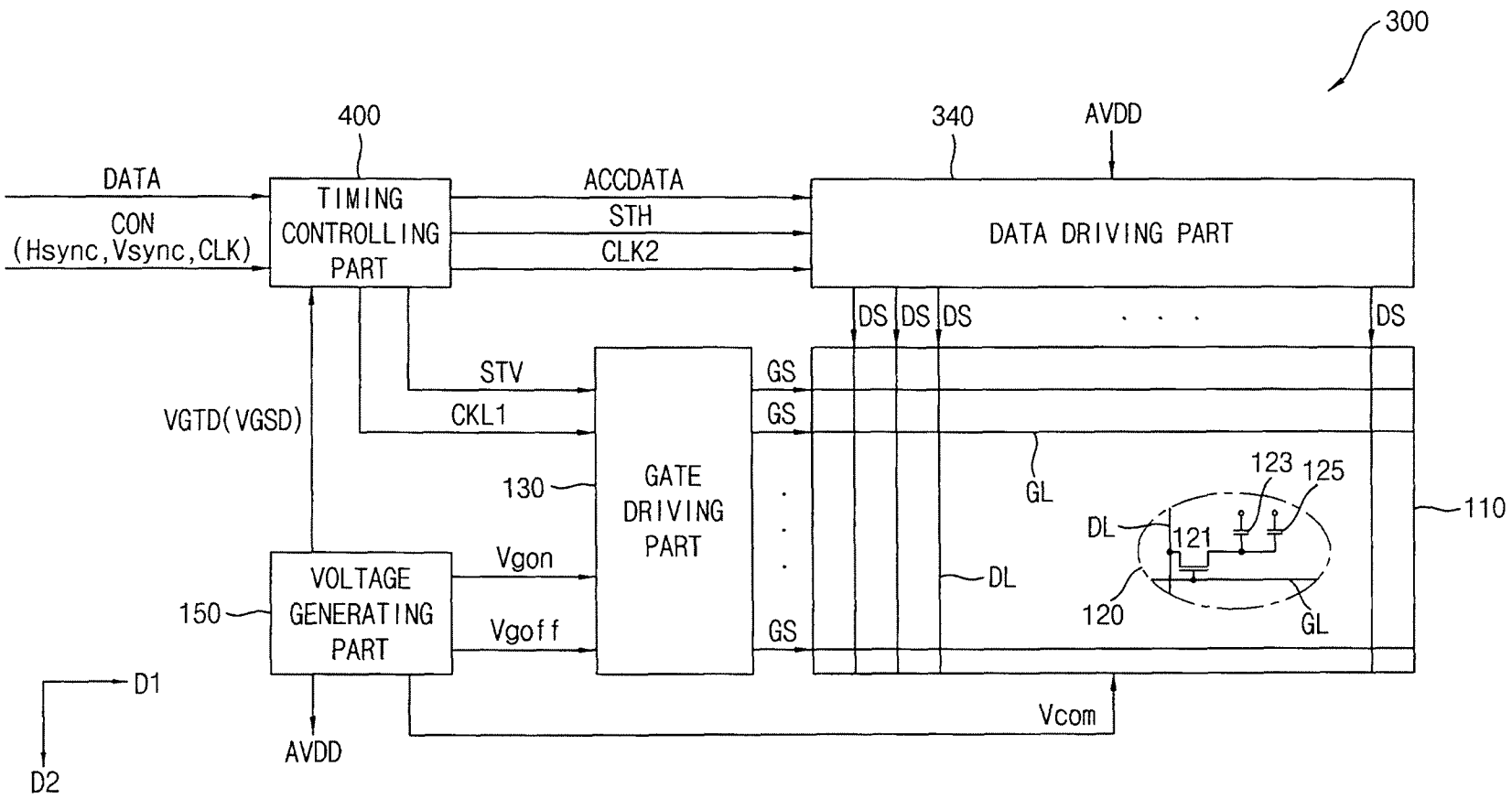
FIG. 4 is a block diagram illustrating a display apparatus according to an exemplary embodiment of the present inventive concept.

FIG. 4 is a block diagram illustrating a display apparatus according to an exemplary embodiment of the present inventive concept.

According to an exemplary embodiment of the present inventive concept, the display apparatus 300 illustrated in FIG. 4 is substantially the same as the display apparatus 100 according to the exemplary embodiment illustrated in FIG. 1 except for a data driving part 340 and a timing controlling part 400. Thus, the same reference numerals will be used to refer to the same or like parts as those previously described and any further repetitive explanation concerning the above elements will be omitted.

Referring to FIG. 4, the display apparatus 300 according to an exemplary embodiment of the present inventive concept includes the display panel 110, the gate driving part 130, the data driving part 340, the voltage generating part 150 and the timing controlling part 400. The gate driving part, the data driving part 340, the voltage generating part 150 and the timing controlling part the 400 are used to drive the display panel 110, and thus the gate driving part, the data driving part 340, the voltage generating part 150 and the timing controlling part 400 may be referred to as a display panel driving apparatus.

The data driving part 340 outputs the data signals DS based on Accurate Color Capture (ACC) compensation image data ACCDATA provided from the timing controlling part 400 to the data line DL in response to the horizontal start signal STH and the second clock signal CLK2 provided from the timing controlling part 400.

The timing controlling part 400 receives the image data DATA and the control signal CON from an outside source. The control signal CON may include the horizontal synchronous signal Hsync, the vertical synchronous signal Vsync and the clock signal CLK. The timing controlling part 400 generates the horizontal start signal STH using the horizontal synchronous signal Hsync and outputs the horizontal start signal STH to the data driving part 340. The timing controlling part 400 generates the vertical start signal STV using the vertical synchronous signal Vsync and outputs the vertical start signal STV to the gate driving part 130. In addition, the timing controlling part 400 generates the first clock signal CLK1 and the second clock signal CLK2 using the clock signal CLK, outputs the first clock signal CLK1 to the gate driving part 130, and outputs the second clock signal CLK2 to the data driving part 340.

The timing controlling part 400 receives voltage generating part state data VGSD indicating a state of the voltage generating part 150. For example, the timing controlling part 400 may receive voltage generating part temperature data VGTD indicating the temperature of the voltage generating part 150.

The timing controlling part 400 may perform an Accurate Color Capture (ACC) compensation according to the voltage generating part temperature data VGTD on the image data DATA and may output the ACC compensation image data ACCDATA.

Figure 5:
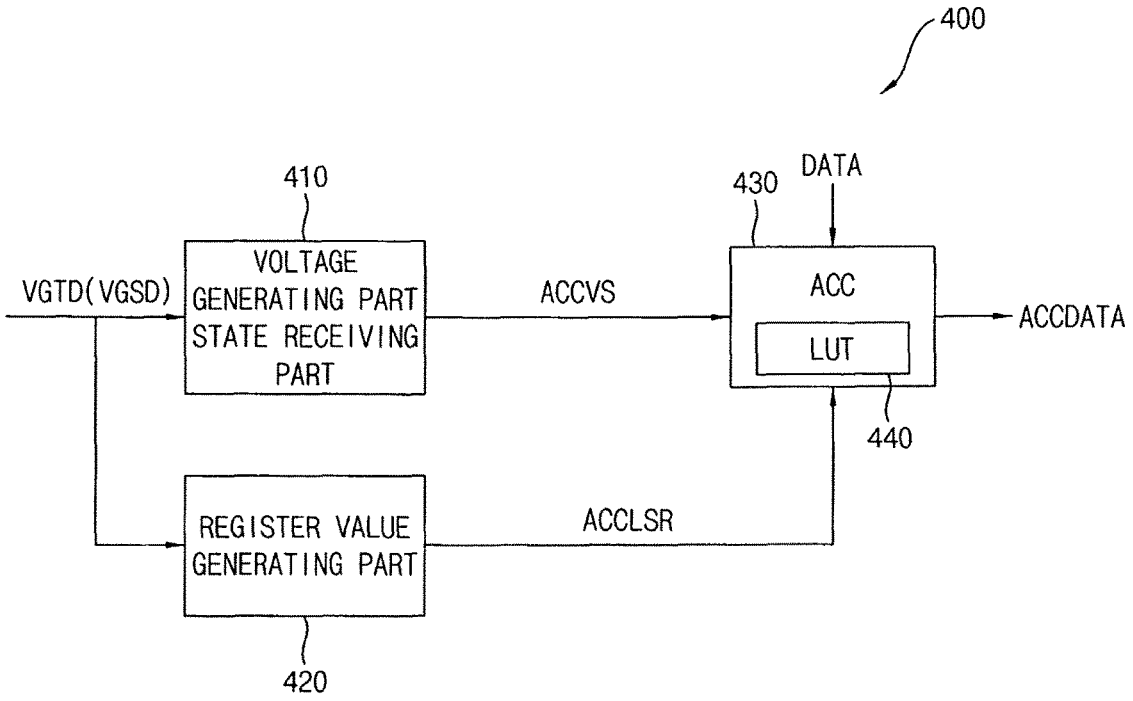
FIG. 5 is a block diagram illustrating a timing controlling part of FIG. 4 according to an exemplary embodiment of the present inventive concept.

FIG. 5 is a block diagram illustrating the timing controlling part 400 of FIG. 4 according to an exemplary embodiment of the present inventive concept.

Referring to FIGS. 4 and 5, the timing controlling part 400 includes a voltage generating part state receiving part 410, a register value generating part 420 and an ACC compensating part 430.

The voltage generating part state receiving part 410 receives, from the voltage generating part 150, the voltage generating part temperature data VGTD. The voltage generating part temperature data VGTD indicates the temperature of the voltage generating part 150. The voltage generating part temperature data VGTD may be included among pieces of the voltage generating part state data VGSD indicating the state of the voltage generating part 150. For example, the voltage generating part state receiving part 410 may receive the voltage generating part temperature data VGTD from the voltage generating part 150 through an Inter-Integrated Circuit (I2C) communication. The voltage generating part state receiving part 410 outputs an ACC compensation value selection signal ACCVS to the ACC compensating part 430 according to the voltage generating part temperature data VGTD. The ACC compensation value selection signal ACCVS controls an operation of the timing controlling part 400, and thus the ACC compensation value selection signal ACCVS may be a timing controlling part control signal.

The register value generating part 420 receives the voltage generating part temperature data VGTD from the voltage generating part 150 and outputs an ACC compensation look-up table selection register value ACCLSR to the ACC compensating part 430 according to the voltage generating part temperature data VGTD.

The ACC compensating part 430 includes an ACC compensation look-up table 440. The ACC compensating part 430 selects an ACC compensation value in the ACC compensation look-up table 440 according to the ACC compensation value selection signal ACCVS. The ACC compensating part 430 performs the ACC compensation on the image data DATA using the ACC compensation value, and outputs the ACC compensation image data ACCDATA. The ACC compensating part 430 may include a plurality of ACC compensation look-up tables 440. In this case, the ACC compensating part 430 may select one ACC compensation look-up table 440 of the ACC compensation look-up tables 440 according to the ACC compensation look-up table selection register value ACCLSR.

When the temperature of the voltage generating part 150 is not less than a reference temperature, the voltage generating part state receiving part 410 may output an ACC compensation value selection signal ACCVS. The ACC compensation value selection signal ACCVS indicates an ACC compensation value which may prevent degradation of the display quality of an image displayed on the display panel 110, according to the voltage generating part temperature data VGTD. The ACC compensating part 430 may perform the ACC compensation on the image data DATA using the ACC compensation value for preventing degradation of the display quality of an image, according to the ACC compensation value selection signal ACCVS, and may output the ACC compensation image data ACCDATA.

Figure 6:
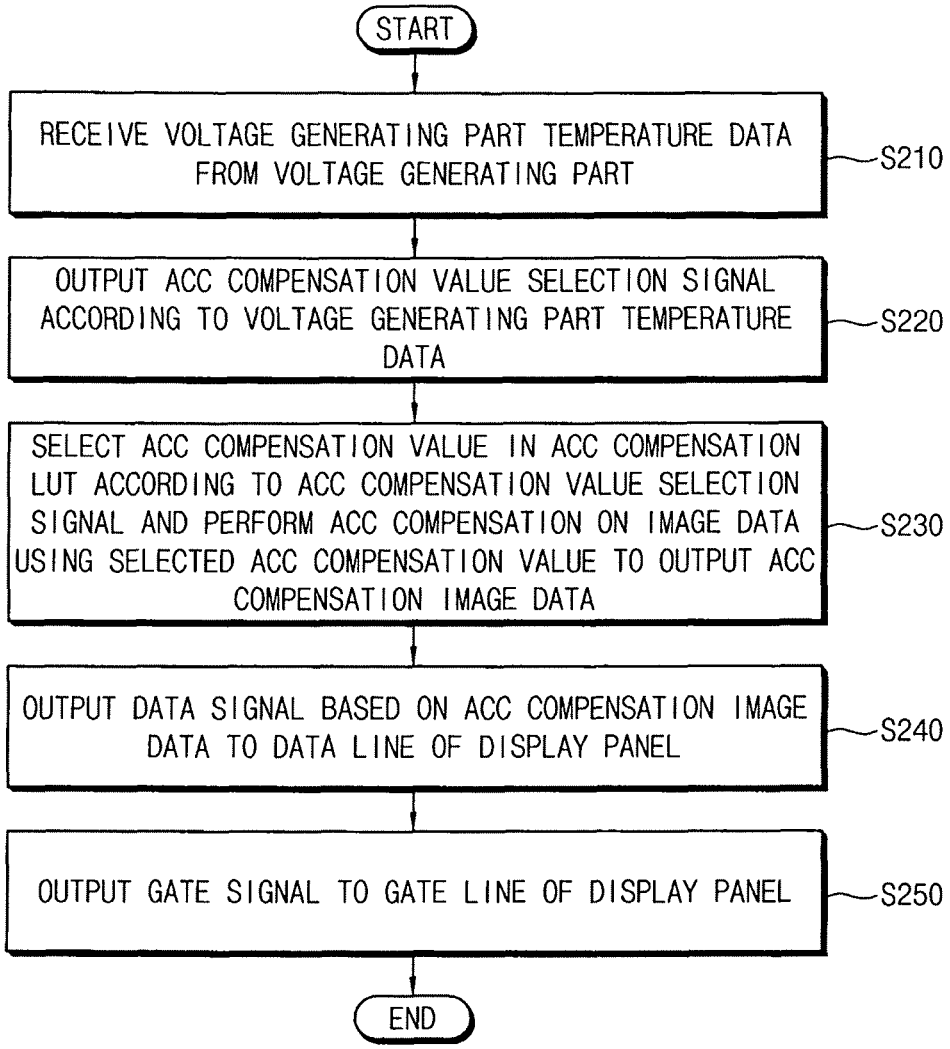
FIG. 6 is a flow chart illustrating a method of driving a display panel, using a display panel driving apparatus of FIG. 4 according to an exemplary embodiment of the present inventive concept.

FIG. 6 is a flow chart illustrating a method of driving a display panel, using the display panel driving apparatus of FIG. 4 according to an exemplary embodiment of the present inventive concept.

Referring to FIGS. 4 to 6, the voltage generating part temperature data VGTD is received from the voltage generating part 150 (step S210). The voltage generating part state receiving part 410 receives, from the voltage generating part 150, the voltage generating part temperature data VGTD indicating the temperature of the voltage generating part 150, among the pieces of the voltage generating part state data VGSD indicating the state of the voltage generating part 150. For example, the voltage generating part state receiving part 410 may receive the voltage generating part temperature data VGTD from the voltage generating part 150 through the I2C communication.

The ACC compensation value selection signal ACCVS is output according to the voltage generating part temperature data VGTD (step S220). The voltage generating part state receiving part 410 outputs the ACC compensation value selection signal ACCVS to the ACC compensating part 430 according to the voltage generating part temperature data VGTD. When the temperature of the voltage generating part 150 is not less than the reference temperature, the voltage generating part state receiving part 410 may output the ACC compensation value selection signal ACCVS according to the voltage generating part temperature data VGTD for selecting the ACC compensation value to prevent degradation of the display quality of an image displayed on the display panel 110. The ACC compensation value selection signal ACCVS controls the operation of the timing controlling part 400, and thus the ACC compensation value selection signal ACCVS may be the timing controlling part control signal.

The ACC compensation value is selected in the ACC compensation look-up table 440 according to the ACC compensation value selection signal ACCVS. The ACC compensation performed on the image data DATA is based on the ACC compensation value, and the ACC compensation image data ACCDATA is output (step S230). The ACC compensating part 430 includes the ACC compensation look-up table 440. The ACC compensating part 430 selects the ACC compensation value in the ACC compensation look-up table 440 according to the ACC compensation value selection signal ACCVS. The ACC compensating part 430 performs the ACC on the image data DATA using the ACC compensation value, and outputs the ACC compensation image data ACCDATA.

The data signal DS based on the ACC compensation image data ACCDATA is output to the data line DL of the display panel 110 (step S240). The data driving part 340 outputs the data signals DS based on the ACC compensation image data ACCDATA provided from the timing controlling part 400 to the data line DL in response to the horizontal start signal STH and the second clock signal CLK2 provided from the timing controlling part 400.

The gate signal GS is output to the gate line GL of the display panel 110 (step S250). The gate driving part 130 generates the gate signal GS in response to the vertical start signal STV and the first clock signal CLK1 provided from the timing controlling part 400, and outputs the gate signal GS to the gate line GL.

In an exemplary embodiment of the present inventive concept, the voltage generating part state receiving part 410, the register value generating part 420 and the ACC compensating part 430 are disposed in the timing controlling part 400. However, the present inventive concept is not limited thereto. For example, the voltage generating part state receiving part 410, the register value generating part 420 and the ACC compensating part 430 may be located outside the timing controlling part 400.

According to an exemplary embodiment of the present inventive concept, when the temperature of the voltage generating part 150 is not less than the reference temperature, the voltage generating part state receiving part 410 may output the ACC compensation value selection signal ACCVS for selecting the ACC compensation value. The ACC compensation value selection signal ACCVS may be selected to prevent degradation of the display quality of an image displayed on the display panel 110, according to the voltage generating part temperature data VGTD. The ACC compensating part 430 may perform the ACC compensation on the image data DATA using the ACC compensation value for preventing degradation of the display quality of an image on the image data DATA, according to the ACC compensation selection signal ACCVS, and may output the ACC compensation data ACCDATA. Thus, degradation of the display quality of the display apparatus 300 may be prevented.

Figure 7:
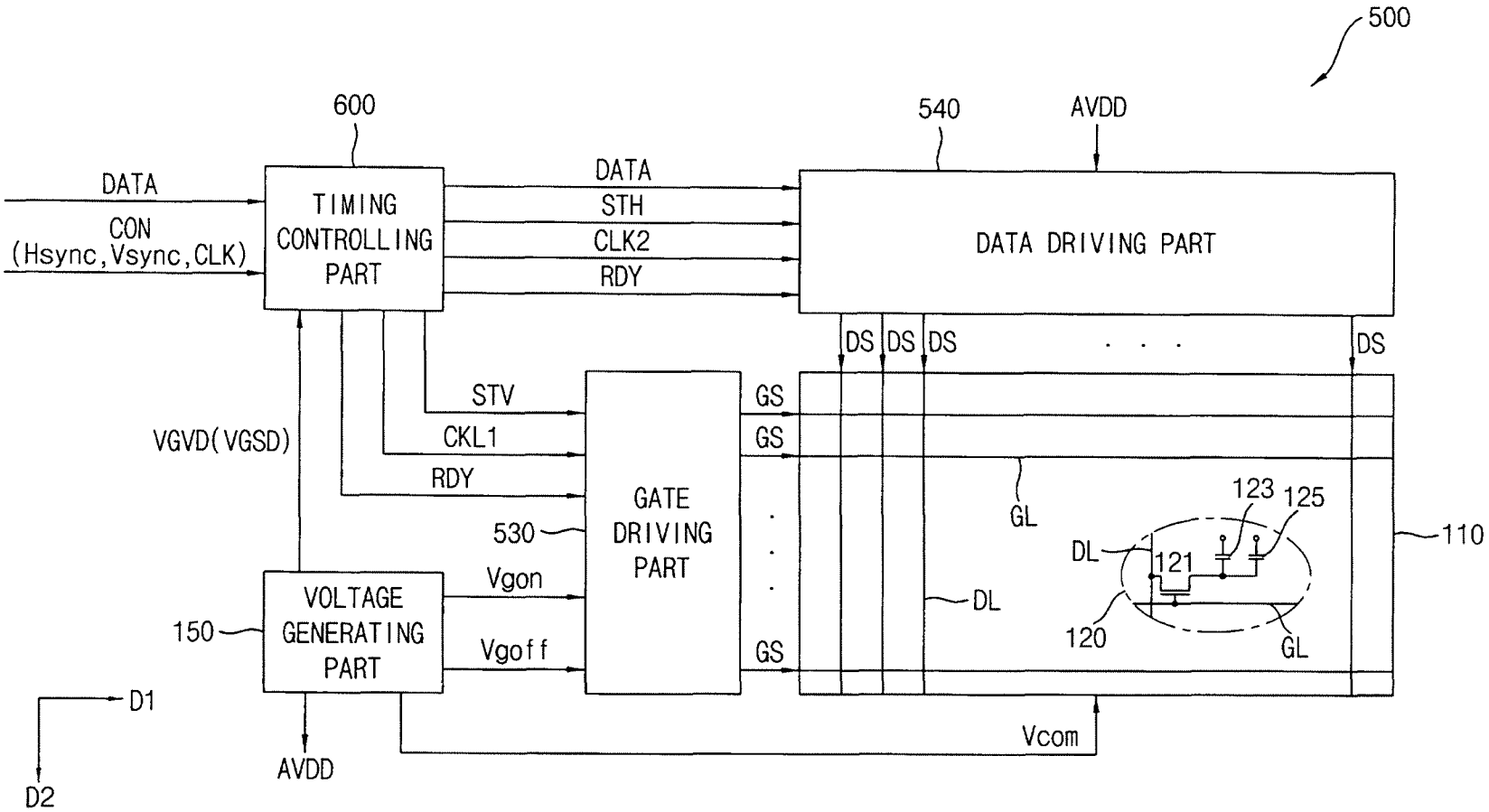
FIG. 7 is a block diagram illustrating a display apparatus according to an exemplary embodiment of the present inventive concept.

FIG. 7 is a block diagram illustrating a display apparatus according to an exemplary embodiment of the present inventive concept.

According to an exemplary embodiment of the present inventive concept, the display apparatus 500 illustrated in FIG. 7 is substantially the same as the display apparatus 100 according to the previous exemplary embodiment illustrated in FIG. 1 except for a gate driving part 530, a data driving part 540 and a timing controlling part 600. Thus, the same reference numerals will be used to refer to same or like parts as those described previously and any further repetitive explanation concerning the above elements will be omitted.

Referring to FIG. 7, the display apparatus 500 according to an exemplary embodiment of the present inventive concept includes the display panel 110, the gate driving part 530, the data driving part 540, the voltage generating part 150 and the timing controlling part 600. The gate driving part 530, the data driving part 540, the voltage generating part 150 and the timing controlling part 600 are used in a driving of the display panel 110, and thus the gate driving part 530, the data driving part 540, the voltage generating part 150 and the timing controlling part 600 may be referred to as a display panel driving apparatus.

The gate driving part 530 generates the gate signal GS in response to the vertical start signal STV and the first clock signal CLK1 provided from the timing controlling part 600, and outputs the gate signal GS to the gate line GL.

The data driving part 540 outputs the data signals DS based on the image data DATA provided from the timing controlling part 600 to the data line DL in response to the horizontal start signal STH and the second clock signal CLK2 provided from the timing controlling part 600.

The timing controlling part 600 receives the image data DATA and the control signal CON from an outside source. The control signal CON may include the horizontal synchronous signal Hsync, the vertical synchronous signal Vsync and the clock signal CLK. The timing controlling part 600 generates the horizontal start signal STH using the horizontal synchronous signal Hsync and outputs the horizontal start signal STH to the data driving part 540. In addition, the timing controlling part 600 generates the vertical start signal STV using the vertical synchronous signal Vsync and outputs the vertical start signal STV to the gate driving part 530. In addition, the timing controlling part 600 generates the first clock signal CLK1 and the second clock signal CLK2 using the clock signal CLK, outputs the first clock signal CLK1 to the gate driving part 530, and outputs the second clock signal CLK2 to the data driving part 540.

The timing controlling part 600 receives the voltage generating part state data VGSD indicating the state of the voltage generating part 150. For example, the timing controlling part 600 may receive voltage generating part voltage data VGVD indicating the voltage of the voltage generating part 150.

The timing controlling part 600 outputs a ready signal RDY which is activated or deactivated according to the voltage generating part voltage data VGVD to the gate driving part 530 and the data driving part 540. For example, when the ready signal RDY is a high level, the ready signal RDY may be activated, and when the ready signal RDY is a low level, the ready signal RDY may be deactivated. For example, the high level and the low level may be a logic high level and the logic low level. When the ready signal RDY is activated, the gate driving part 530 and the data driving part 540 are driven. When the ready signal RDY is deactivated, the gate driving part 530 and the data driving part 540 are no longer driven.

Figure 8:
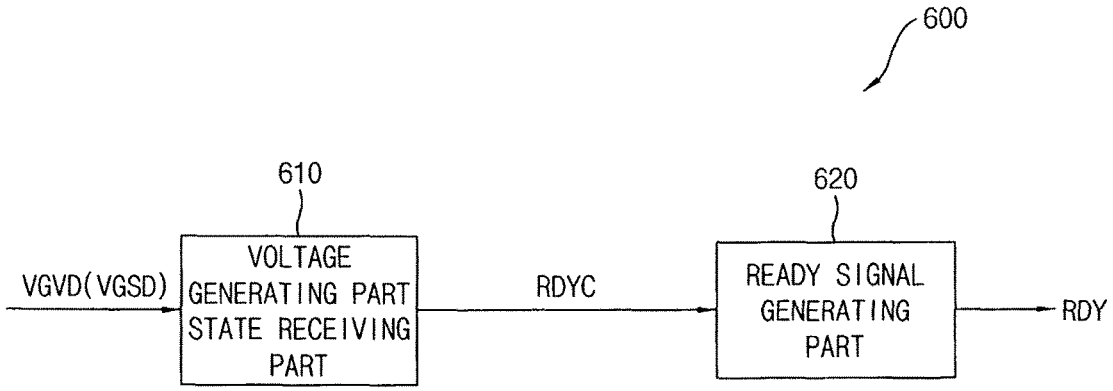
FIG. 8 is a block diagram illustrating a timing controlling part of FIG. 7 according to an exemplary embodiment of the present inventive concept.

FIG. 8 is a block diagram illustrating the timing controlling part 600 of FIG. 7 according to an exemplary embodiment of the present inventive concept.

Referring to FIGS. 7 and 8, the timing controlling part 600 includes a voltage generating part state receiving part 610 and a ready signal generating part 620.

The voltage generating part state receiving part 610 receives, from the voltage generating part 150, the voltage generating part voltage data VGVD. The voltage generating part voltage data VGVD indicates the voltage of the voltage generating part 150. The voltage generating part voltage data VGVD may be included among pieces of the voltage generating part state data VGSD indicating the state of the voltage generating part 150. For example, the voltage generating part state receiving part 610 may receive the voltage generating part voltage data VGVD from the voltage generating part 150 through an Inter-Integrated Circuit (I2C) communication. The voltage generating part state receiving part 610 outputs, to the ready signal generating part 620, a ready signal control signal RDYC for controlling the ready signal RDY according to the voltage generating part voltage data VGVD. The ready signal control signal RDYC controls an operation of the timing controlling part 600, and thus the ready signal control signal RDYC may be a timing controlling part control signal.

The ready signal generating part 620 outputs the ready signal RDY having a high level or a low level according to the ready signal control signal RDYC.

When the voltage of the voltage generating part 150 is less than a reference voltage, the voltage generating state receiving part 610 may output the ready signal control signal RDYC for outputting the ready signal RDY having the high level according to the voltage generating part voltage data VGVD. The ready signal generating part 620 may output the ready signal RDY having the high level according to the ready signal control signal RDYC.

When the voltage of the voltage generating part 150 is not less than the reference voltage, the voltage generating state receiving part 610 may output the ready signal control signal RDYC for outputting the ready signal RDY having the low level according to the voltage generating part voltage data VGVD. The ready signal generating part 620 may output the ready signal RDY having the low level according to the ready signal control signal RDYC.

Figure 9:
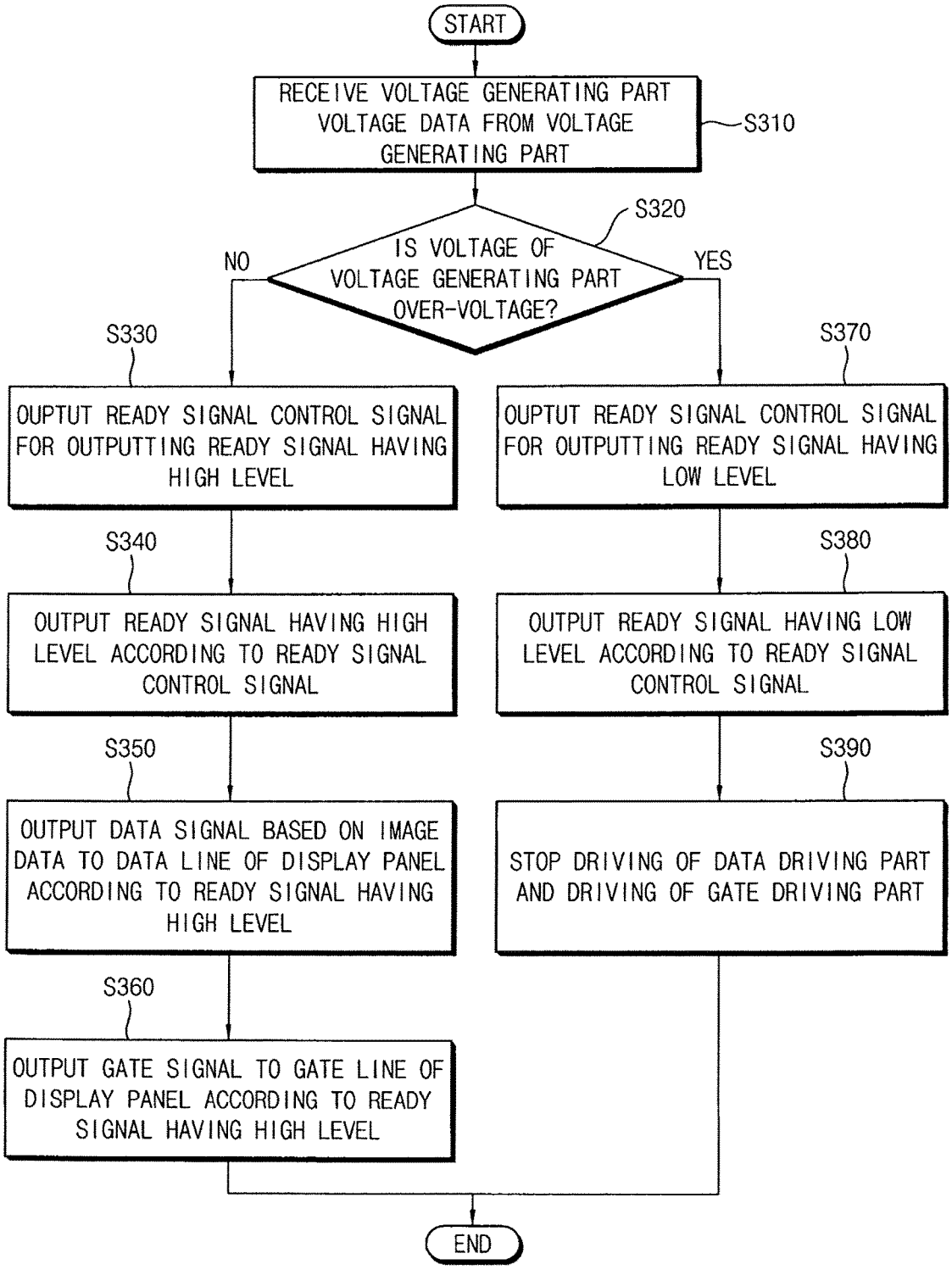
FIG. 9 is a flow chart illustrating a method of driving a display panel, using a display panel driving apparatus of FIG. 7 according to an exemplary embodiment of the present inventive concept.

FIG. 9 is a flow chart illustrating a method of driving a display panel, using the display panel driving apparatus of FIG. 7 according to an exemplary embodiment of the present inventive concept.

Referring to FIGS. 7 to 9, the voltage generating part voltage data VGVD is received from the voltage generating part 150 (step S310). The voltage generating part state receiving part 610 receives, from the voltage generating part 150, the voltage generating part voltage data VGVD indicating the voltage of the voltage generating part 150, among the pieces of the voltage generating part state data VGSD indicating the state of the voltage generating part 150. For example, the voltage generating part state receiving part 610 may receive the voltage generating part voltage data VGVD from the voltage generating part 150 through the Inter-Integrated Circuit (I2C) communication.

It is determined that the voltage of the voltage generating part 150 is an over-voltage (step S320). The voltage generating part state receiving part 610 analyzes the voltage generating part voltage data VGVD and determines whether the voltage of the voltage generating part 150 is not less than the reference voltage.

When the voltage of the voltage generating part 150 is not the over-voltage, the ready signal control signal RDYC for outputting the ready signal RDY having the high level is output (step S330). The voltage generating part state receiving part 610 outputs the ready signal control signal RDYC for outputting the ready signal RDY having the high level according to the voltage generating part voltage data VGVD.

The ready signal RDY having the high level is output according to the ready signal control signal RDYC (step S340). The ready signal generating part 620 outputs the ready signal RDY having the high level according to the ready signal control signal RDYC.

The data signal DS based on the image data DATA is output to the data line DL of the display panel 110 according to the ready signal RDY having the high level (step S350). The data driving part 540 is driven according to the ready signal RDY having the high level. Thus, the data driving part 540 outputs the data signals DS based on the image data DATA provided from the timing controlling part 600 to the data line DL in response to the horizontal start signal STH and the second clock signal CLK2 provided from the timing controlling part 600.

The gate signal GS is output to the gate line GL of the display panel 110 according to the ready signal RDY having the high level (step S360). The gate driving part 530 is driven according to the ready signal RDY having the high level. Thus, the gate driving part 530 generates the gate signal GS in response to the vertical start signal STV and the first clock signal CLK1 provided from the timing controlling part 600, and outputs the gate signal GS to the gate line GL.

When the voltage of the voltage generating part 150 is the over-voltage, the ready signal control signal RDYC for outputting the ready signal RDY having the low level is output (step S370). The voltage generating part state receiving part 610 outputs the ready signal control signal RDYC for outputting the ready signal RDY having the low level according to the voltage generating part voltage data VGVD.

The ready signal RDY having the low level is output according to the ready signal control signal RDYC (step S380). The ready signal generating part 620 outputs the ready signal RDY having the low level according to the ready signal control signal RDYC.

The driving of the gate driving part 530 and the driving of the data driving part 540 are stopped according to the ready signal RDY having the low level (step S390).

In an exemplary embodiment of the present inventive concept, the voltage generating part state receiving part 610 and the ready signal generating part 620 are disposed in the timing controlling part 600. However, the present inventive concept is not limited thereto. For example, the voltage generating part state receiving part 610 and the ready signal generating part 620 may be located outside the timing controlling part 600.

According to an exemplary embodiment of the present inventive concept, when the voltage of the voltage generating part 150 is not less than the reference voltage, the driving of the gate driving part 530 and the driving of the data driving part 540 are stopped according to the ready signal RDY having the low level. Thus, damage to the gate driving part 530, the data driving part 540, the timing controlling part 600 and the display panel 110 may be prevented.

Figure 10:
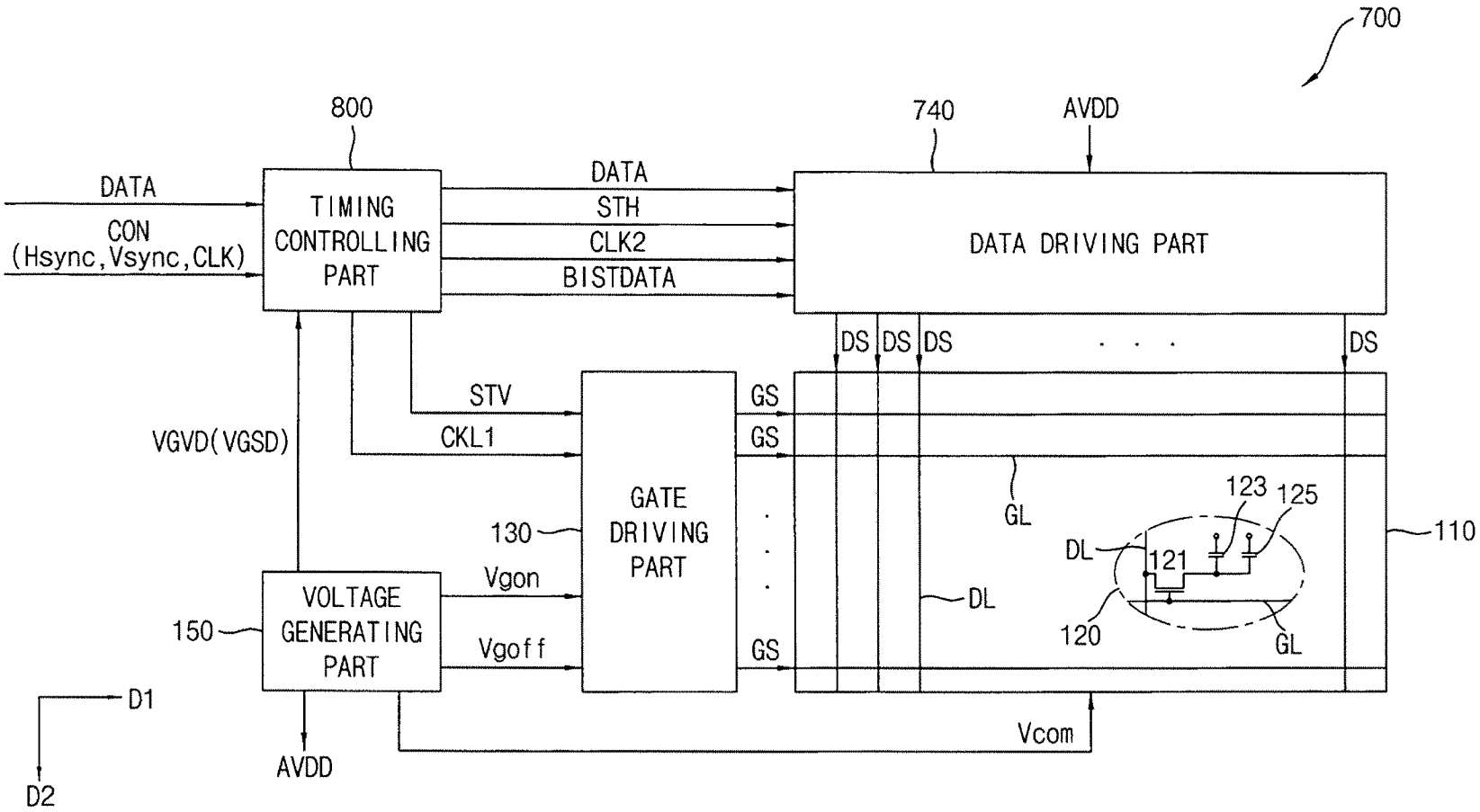
FIG. 10 is a block diagram illustrating a display apparatus according to an exemplary embodiment of the present inventive concept.

FIG. 10 is a block diagram illustrating a display apparatus according to an exemplary embodiment of the present inventive concept.

The display apparatus 700 according to the present exemplary embodiment illustrated in FIG. 10 is substantially the same as the display apparatus 100 according to the previous exemplary embodiment illustrated in FIG. 1 except for a data driving part 740 and a timing controlling part 800. Thus, the same reference numerals will be used to refer to same or like parts as those described previous and any further repetitive explanation concerning the above elements will be omitted.

Referring to FIG. 10, the display apparatus 700 according to an exemplary embodiment of the present inventive concept includes the display panel 110, the gate driving part 130, the data driving part 740, the voltage generating part 150 and the timing controlling part 800. The gate driving part 130, the data driving part 740, the voltage generating part 150 and the timing controlling part 800 are to drive the display panel 110, and thus the gate driving part 130, the data driving part 740, the voltage generating part 150 and the timing controlling part 800 may be referred to as a display panel driving apparatus.

The data driving part 740 outputs the data signals DS based on the image data DATA or Built-In Self Test (BIST) data BISTDATA provided from the timing controlling part 800 to the data line DL in response to the horizontal start signal STH and the second clock signal CLK2 provided from the timing controlling part 800.

The timing controlling part 800 receives the image data DATA and the control signal CON from an outside source. The control signal CON may include the horizontal synchronous signal Hsync, the vertical synchronous signal Vsync and the clock signal CLK. The timing controlling part 800 generates the horizontal start signal STH using the horizontal synchronous signal Hsync and outputs the horizontal start signal STH to the data driving part 740. In addition, the timing controlling part 800 generates the vertical start signal STV using the vertical synchronous signal Vsync and outputs the vertical start signal STV to the gate driving part 730. In addition, the timing controlling part 800 generates the first clock signal CLK1 and the second clock signal CLK2 using the clock signal CLK, outputs the first clock signal CLK1 to the gate driving part 130, and outputs the second clock signal CLK2 to the data driving part 740.

The timing controlling part 800 receives the voltage generating part state data VGSD indicating the state of the voltage generating part 150. For example, the timing controlling part 800 may receive voltage generating part voltage data VGVD indicating the voltage of the voltage generating part 150.

The timing controlling part 800 outputs the image data DATA or the BIST data BISTDATA to the data driving part 740 according to the voltage generating part voltage data VGVD.

Figure 11:
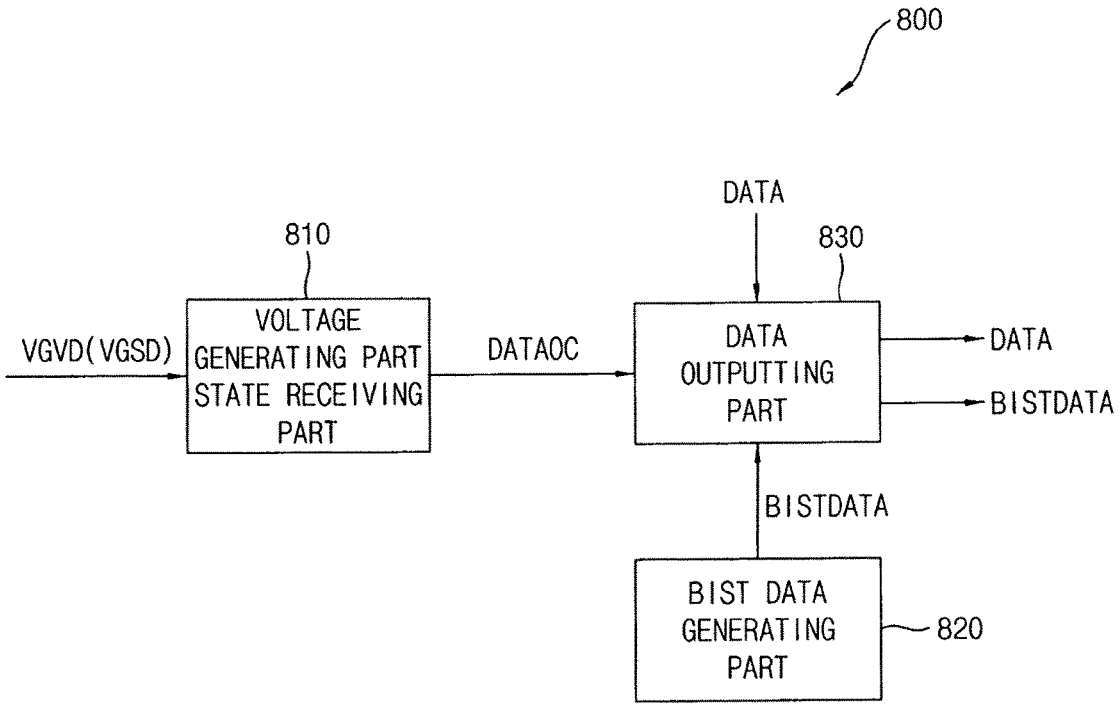
FIG. 11 is a block diagram illustrating a timing controlling part of FIG. 10 according to an exemplary embodiment of the present inventive concept.

FIG. 11 is a block diagram illustrating the timing controlling part 800 of FIG. 10 according to an exemplary embodiment of the present inventive concept.

Referring to FIGS. 10 and 11, the timing controlling part 800 includes a voltage generating part state receiving part 810, a BIST data generating part 820 and a data outputting part 830.

The voltage generating part state receiving part 810 receives, from the voltage generating part 150, the voltage generating part voltage data VGVD. The voltage generating part voltage data VGVD indicates the voltage of the voltage generating part 150. The voltage generating part voltage data VGVD may be included among pieces of the voltage generating part state data VGSD indicating the state of the voltage generating part 150. For example, the voltage generating part state receiving part 810 may receive the voltage generating part voltage data VGVD from the voltage generating part 150 through an Inter-Integrated Circuit (I2C) communication. The voltage generating part state receiving part 810 outputs, to the data outputting part 830, a data output control signal DATAOC for controlling a selective output of the image data DATA and the BIST data BISTDATA according to the voltage generating part voltage data VGVD. The data output control signal DATAOC controls an operation of the timing controlling part 800, and thus the data output control signal DATAOC may be a timing controlling part control signal.

The BIST data generating part 820 outputs the BIST data BISTDATA. The BIST data BISTDATA may be a test pattern.

The data outputting part 830 receives the image data DATA and the BIST data BISTDATA, and outputs the image data DATA or the BIST data BISTDATA to the data driving part 740 according to the data output control signal DATAOC.

When the voltage of the voltage generating part 150 is less than a reference voltage, the voltage generating state receiving part 810 may output the data output control signal DATAOC for outputting the image data DATA according to the voltage generating part voltage data VGVD. For example, the data outputting part 830 may output the image data DATA to the data driving part 740 according to the data output control signal DATAOC.

When the voltage of the voltage generating part 150 is not less than the reference voltage, the voltage generating state receiving part 810 may output the data output control signal DATAOC for outputting the BIST data BISTDATA according to the voltage generating part voltage data VGVD. The data outputting part 830 may output the BIST data BISTDATA to the data driving part 740 according to the data output control signal DATAOC.

Figure 12:
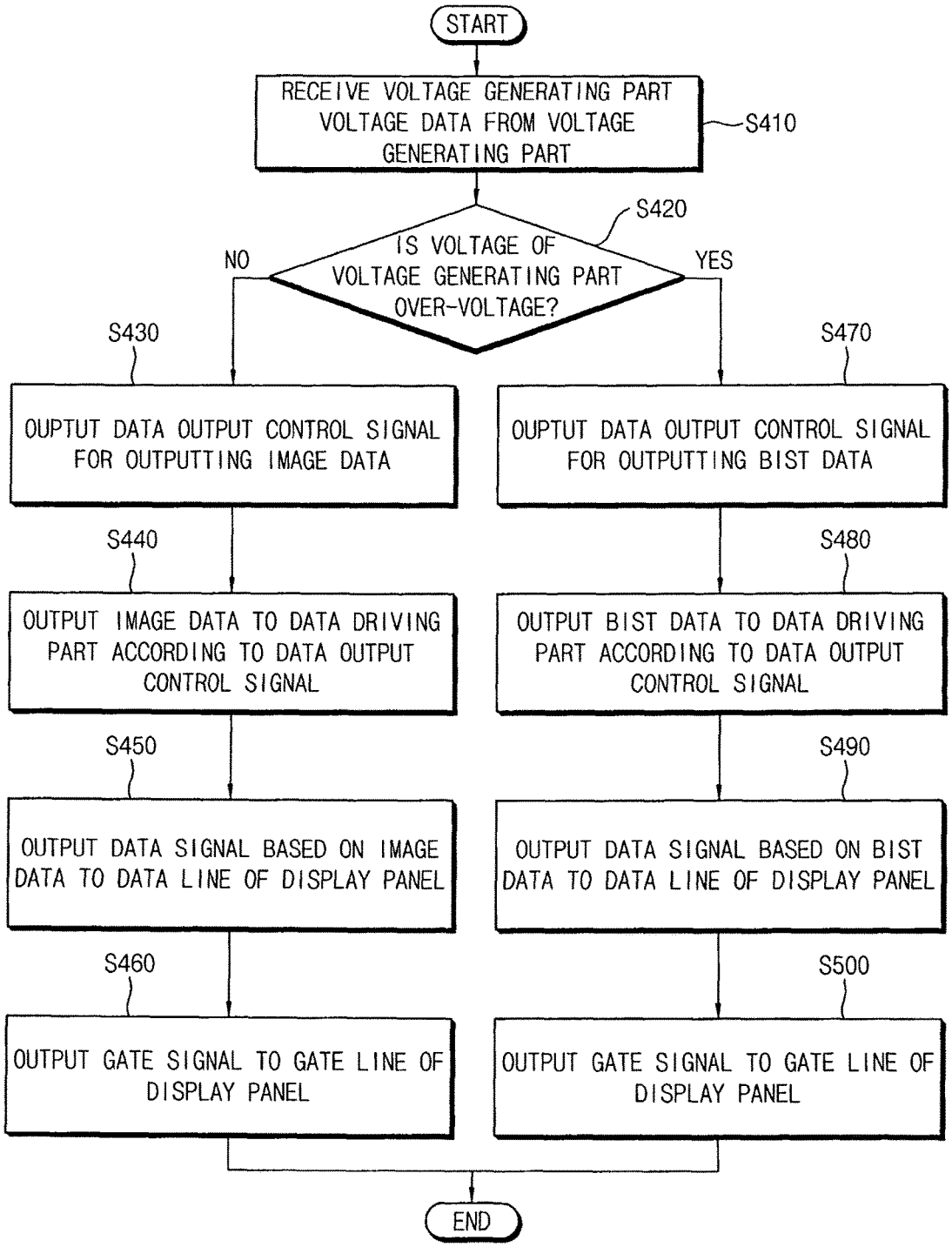
FIG. 12 is a flow chart illustrating a method of driving a display panel, using a display panel driving apparatus of FIG. 10 according to an exemplary embodiment of the present inventive concept.

FIG. 12 is a flow chart illustrating a method of driving a display panel, using the display panel driving apparatus of FIG. 10 according to an exemplary embodiment of the present inventive concept.

Referring to FIGS. 10 to 12, the voltage generating part voltage data VGVD is received from the voltage generating part 150 (step S410). The voltage generating part state receiving part 810 receives, from the voltage generating part 150, the voltage generating part voltage data VGVD indicating the voltage of the voltage generating part 150, among the pieces of the voltage generating part state data VGSD indicating the state of the voltage generating part 150. For example, the voltage generating part state receiving part 810 may receive the voltage generating part voltage data VGVD from the voltage generating part 150 through the Inter-Integrated Circuit (I2C) communication.

It is determined that the voltage of the voltage generating part 150 is an over-voltage (step S420). The voltage generating part state receiving part 810 analyzes the voltage generating part voltage data VGVD and determines whether the voltage of the voltage generating part 150 is not less than the reference voltage.

When the voltage of the voltage generating part 150 is not the over-voltage, the data output control signal DATAOC for outputting the image data DATA is output (step S430). The voltage generating part state receiving part 810 outputs the data output control signal DATAOC for outputting the image data DATA according to the voltage generating part voltage data VGVD.

The image data DATA is output to the data driving part 740 according to the data output control signal DATAOC (step S440). The data outputting part 830 outputs the image data DATA to the data driving part 740 according to the data output control signal DATAOC.

The data signal DS based on the image data DATA is output to the data line DL of the display panel 110 (step S450). The data driving part 740 outputs the data signals DS based on the image data DATA provided from the timing controlling part 800 to the data line DL in response to the horizontal start signal STH and the second clock signal CLK2 provided from the timing controlling part 800.

The gate signal GS is output to the gate line GL of the display panel 110 (step S460). The gate driving part 130 generates the gate signal GS in response to the vertical start signal STV and the first clock signal CLK1 provided from the timing controlling part 800, and outputs the gate signal GS to the gate line GL.

When the voltage of the voltage generating part 150 is the over-voltage, the data output control signal DATAOC for outputting the BIST data BISTDATA is output (step S470). The voltage generating part state receiving part 810 outputs the data output control signal DATAOC for outputting the BIST data BISTDATA according to the voltage generating part voltage data VGVD.

The BIST data BISTDATA is output to the data driving part 740 according to the data output control signal DATAOC (step S480). The data outputting part 830 outputs the BIST data BISTDATA to the data driving part 740 according to the data output control signal DATAOC.

The data signal DS based on the BIST data BISTDATA is output to the data line DL of the display panel 110 (step S490). The data driving part 740 outputs the data signals DS based on the BIST data BISTDATA provided from the timing controlling part 800 to the data line DL in response to the horizontal start signal STH and the second clock signal CLK2 provided from the timing controlling part 800.

The gate signal GS is output to the gate line GL of the display panel 110 (step S500). The gate driving part 130 generates the gate signal GS in response to the vertical start signal STV and the first clock signal CLK1 provided from the timing controlling part 800, and outputs the gate signal GS to the gate line GL.

In an exemplary embodiment of the present inventive concept, the voltage generating part state receiving part 810, the BIST data generating part 820 and the data outputting part 830 are disposed in the timing controlling part 800. However, the present inventive concept is not limited thereto. For example, the voltage generating part state receiving part 810, the BIST data generating part 820 and the data outputting part 830 may be located outside the timing controlling part 800.

According to an exemplary embodiment of the present inventive concept, when the voltage of the voltage generating part 150 is not less than the reference voltage, the BIST data BISTDATA is output from the timing controlling part 800 to the data driving part 740 according to the data output control signal DATAOC. Therefore, loads of the timing controlling part 800, the data driving part 740 and the display panel 110 may be decreased. Thus, damages of the timing controlling part 800, the data driving part 740 and the display panel 110 may be prevented.

Figure 13:
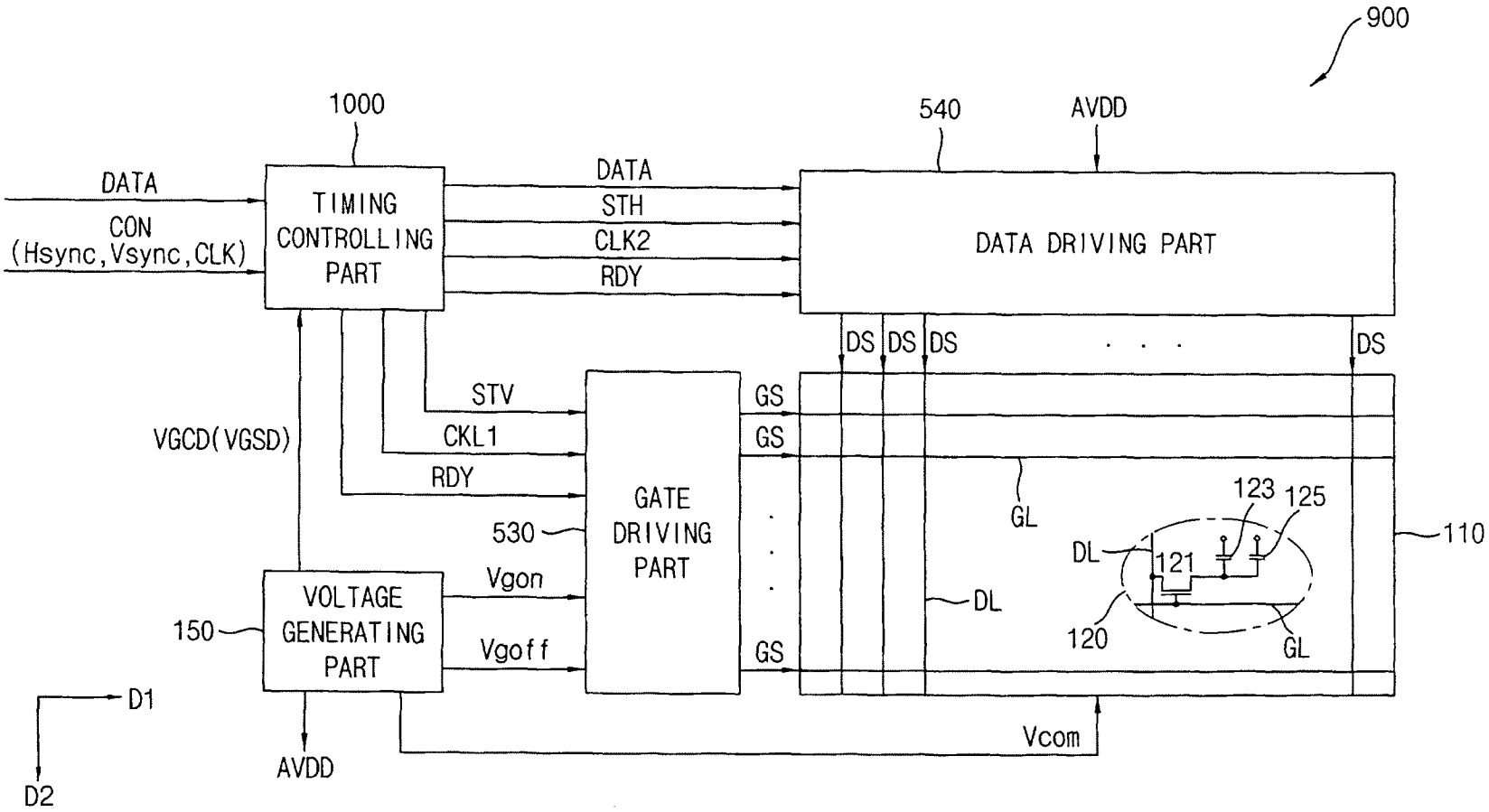
FIG. 13 is a block diagram illustrating a display apparatus according to an exemplary embodiment of the present inventive concept.

FIG. 13 is a block diagram illustrating a display apparatus according to an exemplary embodiment of the present inventive concept.

According to an exemplary embodiment of the present inventive concept, the display apparatus 900 illustrated in FIG. 13 is substantially the same as the display apparatus 100 illustrated in FIG. 1 except for a gate driving part 530, a data driving part 540 and a timing controlling part 1000. Thus, the same reference numerals will be used to refer to same or like parts as those described and any further repetitive explanation concerning the above elements will be omitted.

Referring to FIG. 13, the display apparatus 900 according to an exemplary embodiment of the present inventive concept includes the display panel 110, the gate driving part 530, the data driving part 540, the voltage generating part 150 and the timing controlling part 1000. The gate driving part 530, the data driving part 540, the voltage generating part 150 and the timing controlling part 1000 are used to drive the display panel 110. Thus, the gate driving part 530, the data driving part 540, the voltage generating part 150 and the timing controlling part 1000 may be defined as a display panel driving apparatus.

The gate driving part 530 generates the gate signal GS in response to the vertical start signal STV and the first clock signal CLK1 provided from the timing controlling part 1000, and outputs the gate signal GS to the gate line GL.

The data driving part 540 outputs the data signals DS based on the image data DATA provided from the timing controlling part 1000 to the data line DL in response to the horizontal start signal STH and the second clock signal CLK2 provided from the timing controlling part 1000.

The timing controlling part 1000 receives the image data DATA and the control signal CON from an outside source. The control signal CON may include the horizontal synchronous signal Hsync, the vertical synchronous signal Vsync and the clock signal CLK. The timing controlling part 1000 generates the horizontal start signal STH using the horizontal synchronous signal Hsync and outputs the horizontal start signal STH to the data driving part 540. In addition, the timing controlling part 1000 generates the vertical start signal STV using the vertical synchronous signal Vsync and outputs the vertical start signal STV to the gate driving part 530. In addition, the timing controlling part 1000 generates the first clock signal CLK1 and the second clock signal CLK2 using the clock signal CLK, outputs the first clock signal CLK1 to the gate driving part 530, and outputs the second clock signal CLK2 to the data driving part 540.

The timing controlling part 1000 receives the voltage generating part state data VGSD indicating the state of the voltage generating part 150. For example, the timing controlling part 1000 may receive voltage generating part current data VGCD indicating the current of the voltage generating part 150.

The timing controlling part 1000 outputs a ready signal RDY which is activated or deactivated according to the voltage generating part current data VGCD to the gate driving part 530 and the data driving part 540. For example, when the ready signal RDY is a high level, the ready signal RDY may be activated, and when the ready signal RDY is a low level, the ready signal RDY may be deactivated. When the ready signal RDY is activated, the gate driving part 530 and the data driving part 540 are driven. When the ready signal RDY is deactivated, the driving of the gate driving part 530 and the data driving part 540 are no longer driven.

Figure 14:
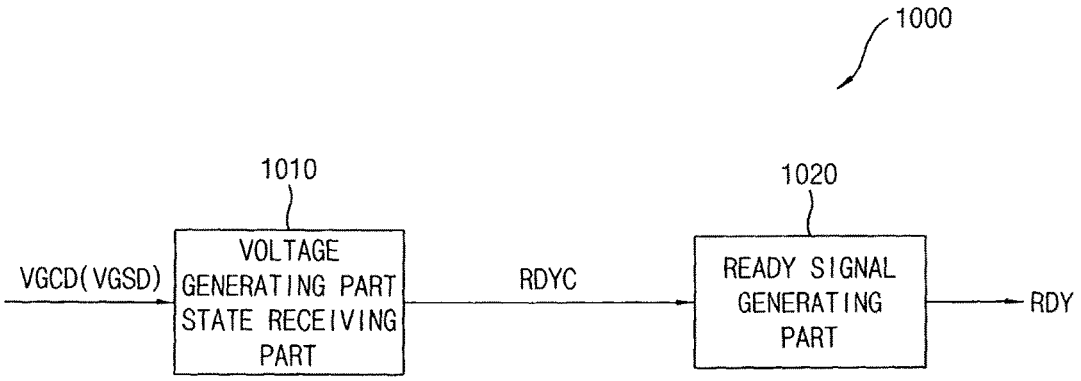
FIG. 14 is a block diagram illustrating a timing controlling part of FIG. 13 according to an exemplary embodiment of the present inventive concept.

FIG. 14 is a block diagram illustrating the timing controlling part 1000 of FIG. 13 according to an exemplary embodiment of the present inventive concept.

Referring to FIGS. 13 and 14, the timing controlling part 1000 includes a voltage generating part state receiving part 1010 and a ready signal generating part 1020.

The voltage generating part state receiving part 1010 receives, from the voltage generating part 150, the voltage generating part current data VGCD. The voltage generating part current data VGCD indicates the current of the voltage generating part 150. The voltage generating part current data VGCD may be included among pieces of the voltage generating part state data VGSD indicating the state of the voltage generating part 150. For example, the voltage generating part state receiving part 1010 may receive the voltage generating part current data VGCD from the voltage generating part 150 through an Inter-Integrated Circuit (I2C) communication. The voltage generating part state receiving part 1010 outputs, to the ready signal generating part 1020, a ready signal control signal RDYC for controlling the ready signal RDY according to the voltage generating part current data VGCD. The ready signal control signal RDYC controls an operation of the timing controlling part 1000, and thus the ready signal control signal RDYC may be a timing controlling part control signal.

The ready signal generating part 1020 outputs the ready signal RDY having a high level or a low level according to the ready signal control signal RDYC.

When the current of the voltage generating part 150 is less than a reference current, the voltage generating state receiving part 1010 may output the ready signal control signal RDYC for outputting the ready signal RDY having the high level according to the voltage generating part current data VGCD. The ready signal generating part 1020 may output the ready signal RDY having the high level according to the ready signal control signal RDYC.

When the current of the voltage generating part 150 is substantially equal to or greater than the reference current, the voltage generating state receiving part 1010 may output the ready signal control signal RDYC for outputting the ready signal RDY having the low level according to the voltage generating part current data VGCD. The ready signal generating part 1020 may output the ready signal RDY having the low level according to the ready signal control signal RDYC.

Figure 15:
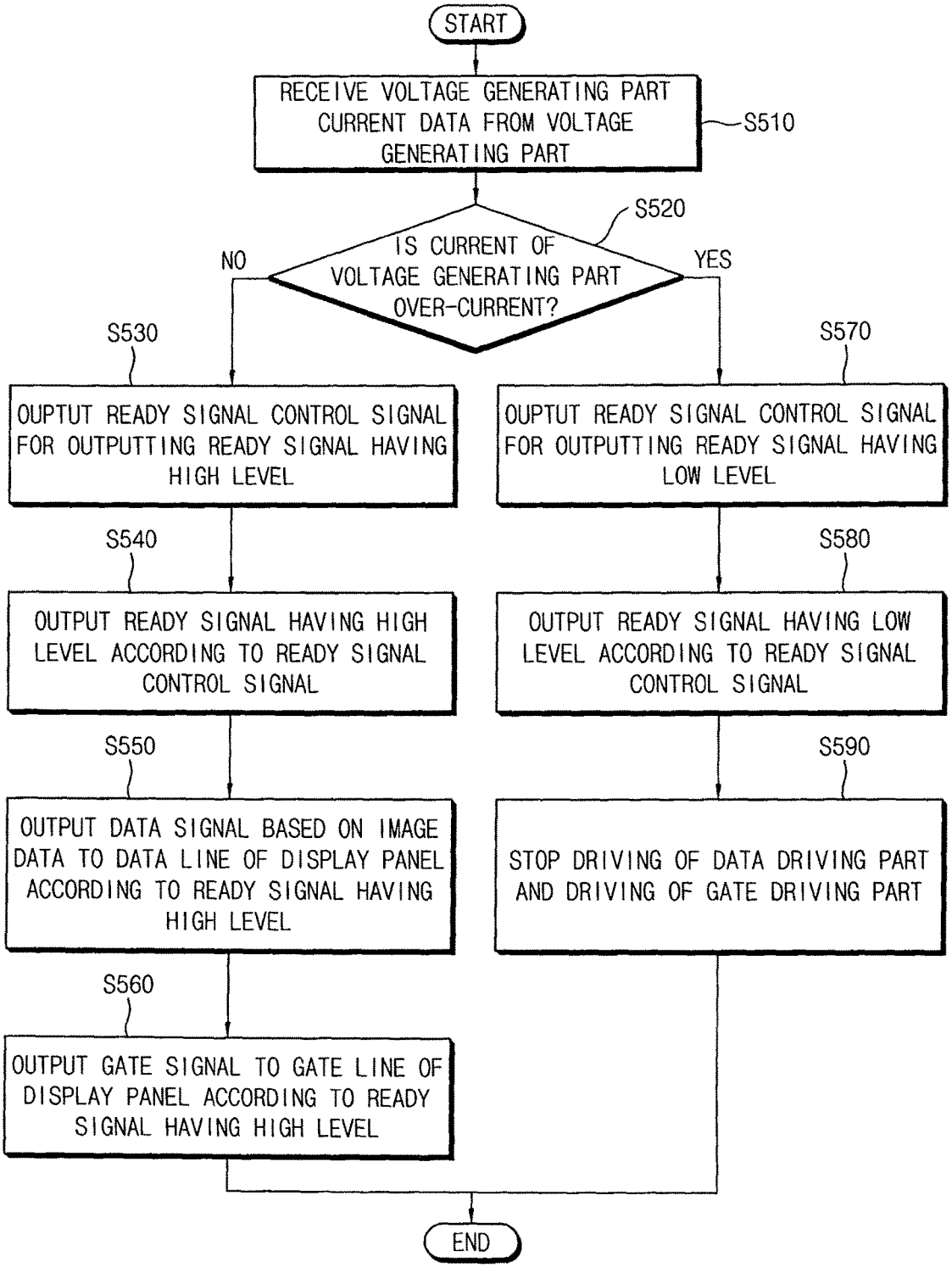
FIG. 15 is a flow chart illustrating a method of driving a display panel, using a display panel driving apparatus of FIG. 13 according to an exemplary embodiment of the present inventive concept.

FIG. 15 is a flow chart illustrating a method of driving a display panel, using the display panel driving apparatus of FIG. 13.

Referring to FIGS. 13 to 15, the voltage generating part current data VGCD is received from the voltage generating part 150 (step S510). The voltage generating part state receiving part 1010 receives, from the voltage generating part 150, the voltage generating part current data VGCD indicating the current of the voltage generating part 150, among the pieces of the voltage generating part state data VGSD indicating the state of the voltage generating part 150. For example, the voltage generating part state receiving part 1010 may receive the voltage generating part current data VGCD from the voltage generating part 150 through the Inter-Integrated Circuit (I2C) communication.

It is determined that the current of the voltage generating part 150 is an over-current (step S520). The voltage generating part state receiving part 1010 analyzes the voltage generating part current data VGCD and determines whether the current of the voltage generating part 150 is not less than the reference current.

When the current of the voltage generating part 150 is not the over-current, the ready signal control signal RDYC for outputting the ready signal RDY having the high level is output (step S530). The voltage generating part state receiving part 1010 outputs the ready signal control signal RDYC for outputting the ready signal RDY having the high level according to the voltage generating part current data VGCD.

The ready signal RDY having the high level is output according to the ready signal control signal RDYC (step S540). The ready signal generating part 1020 outputs the ready signal RDY having the high level according to the ready signal control signal RDYC.

The data signal DS based on the image data DATA is output to the data line DL of the display panel 110 according to the ready signal RDY having the high level (step S550). The data driving part 540 is driven according to the ready signal RDY having the high level. Thus, the data driving part 540 outputs the data signals DS based on the image data DATA provided from the timing controlling part 1000 to the data line DL in response to the horizontal start signal STH and the second clock signal CLK2 provided from the timing controlling part 1000.

The gate signal GS is output to the gate line GL of the display panel 110 according to the ready signal RDY having the high level (step S560). The gate driving part 530 is driven according to the ready signal RDY having the high level. Thus, the gate driving part 530 generates the gate signal GS in response to the vertical start signal STV and the first clock signal CLK1 provided from the timing controlling part 1000, and outputs the gate signal GS to the gate line GL.

When the current of the voltage generating part 150 is the over-current, the ready signal control signal RDYC for outputting the ready signal RDY having the low level is output (step S570). The voltage generating part state receiving part 1010 outputs the ready signal control signal RDYC for outputting the ready signal RDY having the low level according to the voltage generating part current data VGCD.

The ready signal RDY having the low level is output according to the ready signal control signal RDYC (step S580). The ready signal generating part 1020 outputs the ready signal RDY having the low level according to the ready signal control signal RDYC.

The driving of the gate driving part 530 and the driving of the data driving part 540 are stopped according to the ready signal RDY having the low level (step S590).

In an exemplary embodiment of the present inventive concept, the voltage generating part state receiving part 1010 and the ready signal generating part 1020 are disposed in the timing controlling part 1000. However, the present inventive concept is not limited thereto. For example, the voltage generating part state receiving part 1010 and the ready signal generating part 1020 may be located outside the timing controlling part 1000.

According to an exemplary embodiment of the present inventive concept, when the current of the voltage generating part 150 is not less than the reference current, the driving of the gate driving part 530 and the driving of the data driving part 540 are stopped according to the ready signal RDY having the low level. Thus, damages of the gate driving part 530, the data driving part 540, the timing controlling part 1000 and the display panel 110 may be prevented.

Figure 16:
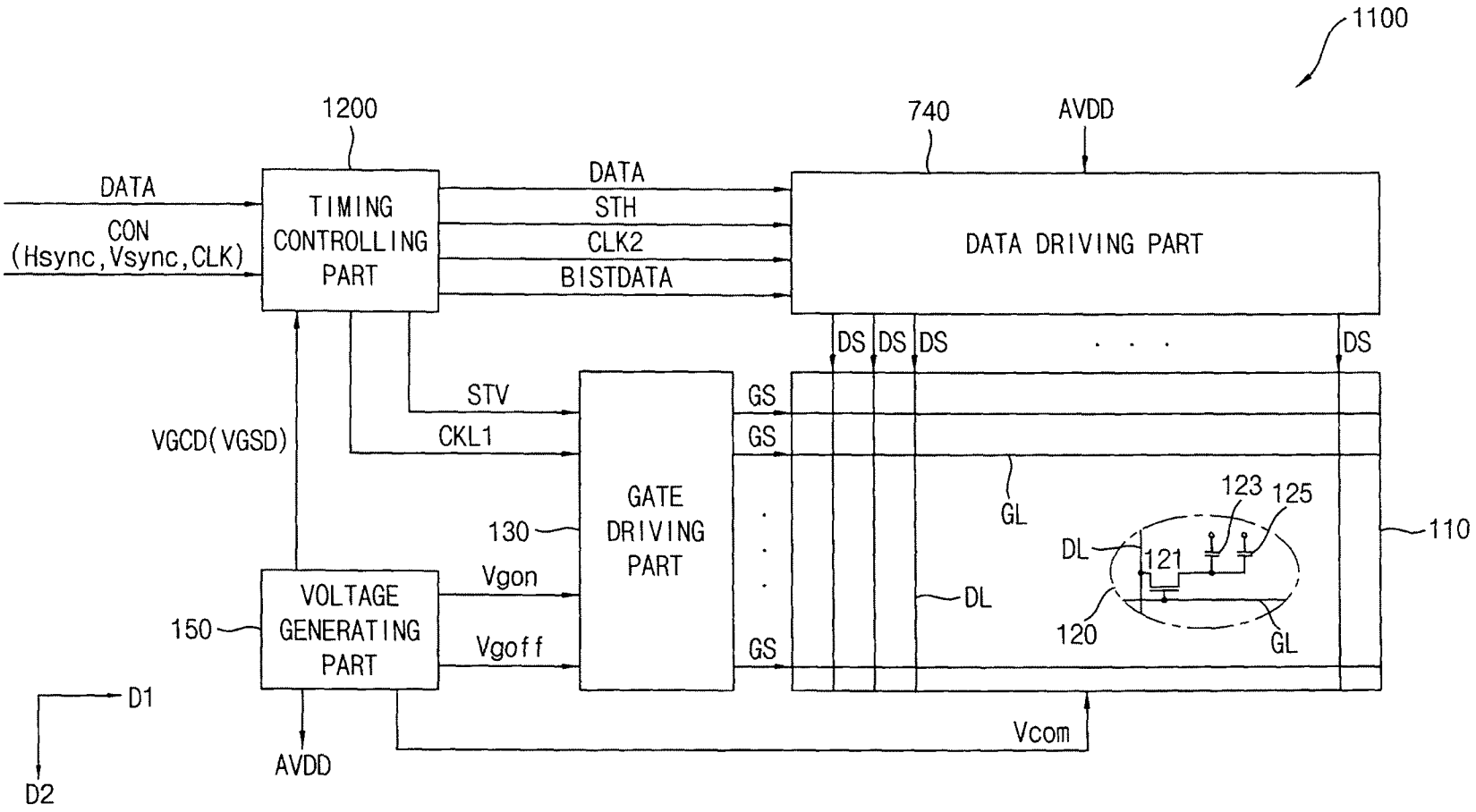
FIG. 16 is a block diagram illustrating a display apparatus according to an exemplary embodiment of the present inventive concept.

FIG. 16 is a block diagram illustrating a display apparatus according to an exemplary embodiment of the present inventive concept.

The display apparatus 1100 according to the present exemplary embodiment illustrated in FIG. 16 is substantially the same as the display apparatus 100 illustrated in FIG. 1 except for a data driving part 740 and a timing controlling part 1200, e.g., a timing controller. Thus, the same reference numerals will be used to refer to same or like parts as those described previously and any further repetitive explanation concerning the above elements will be omitted.

Referring to FIG. 16, the display apparatus 1100 according to an exemplary embodiment of the present inventive concept includes the display panel 110, the gate driving part 130, the data driving part 740, the voltage generating part 150 and the timing controlling part 1200. The gate driving part 130, the data driving part 740, the voltage generating part 150 and the timing controlling part 1200 are used to drive the display panel 110, and thus the gate driving part 130, the data driving part 740, the voltage generating part 150 and the timing controlling part 1200 may be referred to as a display panel driving apparatus.

The data driving part 740 outputs the data signals DS based on the image data DATA or Built-In Self Test (BIST) data BISTDATA provided from the timing controlling part 1200 to the data line DL in response to the horizontal start signal STH and the second clock signal CLK2 provided from the timing controlling part 1200.

The timing controlling part 1200 receives the image data DATA and the control signal CON from an outside source. The control signal CON may include the horizontal synchronous signal Hsync, the vertical synchronous signal Vsync and the clock signal CLK. The timing controlling part 1200 generates the horizontal start signal STH using the horizontal synchronous signal Hsync and outputs the horizontal start signal STH to the data driving part 740. In addition, the timing controlling part 1200 generates the vertical start signal STV using the vertical synchronous signal Vsync and outputs the vertical start signal STV to the gate driving part 730. In addition, the timing controlling part 1200 generates the first clock signal CLK1 and the second clock signal CLK2 using the clock signal CLK, outputs the first clock signal CLK1 to the gate driving part 130, and outputs the second clock signal CLK2 to the data driving part 740.

The timing controlling part 1200 receives the voltage generating part state data VGSD indicating the state of the voltage generating part 150. For example, the timing controlling part 1200 may receive voltage generating part current data VGCD indicating the current of the voltage generating part 150.

The timing controlling part 1200 outputs the image data DATA or the BIST data BISTDATA to the data driving part 740 according to the voltage generating part current data VGCD.

Figure 17:
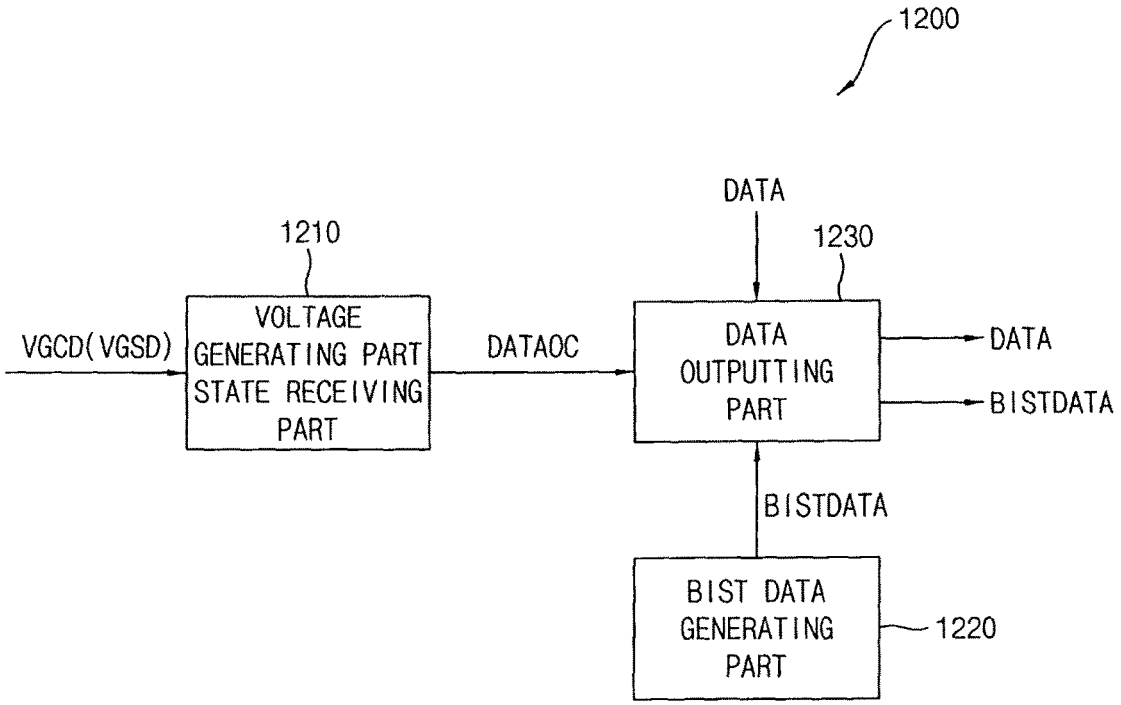
FIG. 17 is a block diagram illustrating a timing controlling part of FIG. 16 according to an exemplary embodiment of the present inventive concept.

FIG. 17 is a block diagram illustrating the timing controlling part 1200 of FIG. 16 according to an exemplary embodiment of the present inventive concept.

Referring to FIGS. 16 and 17, the timing controlling part 1200 includes a voltage generating part state receiving part 1210, a BIST data generating part 1220 and a data outputting part 1230.

The voltage generating part state receiving part 1210 receives, from the voltage generating part 150, the voltage generating part current data VGCD. The voltage generating part current data VGCD indicates the current of the voltage generating part 150. The voltage generating part current data VGCD may be included among pieces of the voltage generating part state data VGSD indicating the state of the voltage generating part 150. For example, the voltage generating part state receiving part 1210 may receive the voltage generating part current data VGCD from the voltage generating part 150 through an Inter-Integrated Circuit (I2C) communication. The voltage generating part state receiving part 1210 outputs, to the data outputting part 1230, a data output control signal DATAOC for controlling a selective output of the image data DATA and the BIST data BISTDATA according to the voltage generating part current data VGCD. The data output control signal DATAOC controls an operation of the timing controlling part 1200, and thus the data output control signal DATAOC may be a timing controlling part control signal.

The BIST data generating part 1220 outputs the BIST data BISTDATA. The BIST data BISTDATA may be a test pattern.

The data outputting part 1230 receives the image data DATA and the BIST data BISTDATA, and outputs the image data DATA or the BIST data BISTDATA to the data driving part 740 according to the data output control signal DATAOC.

When the current of the voltage generating part 150 is less than a reference current, the voltage generating state receiving part 1210 may output the data output control signal DATAOC for outputting the image data DATA according to the voltage generating part current data VGCD. For example, the data outputting part 1230 may output the image data DATA to the data driving part 740 according to the data output control signal DATAOC.

When the current of the voltage generating part 150 is not less than the reference current, the voltage generating state receiving part 1210 may output the data output control signal DATAOC for outputting the BIST data BISTDATA according to the voltage generating part current data VGCD. The data outputting part 1230 may output the BIST data BISTDATA to the data driving part 740 according to the data output control signal DATAOC.

Figure 18:
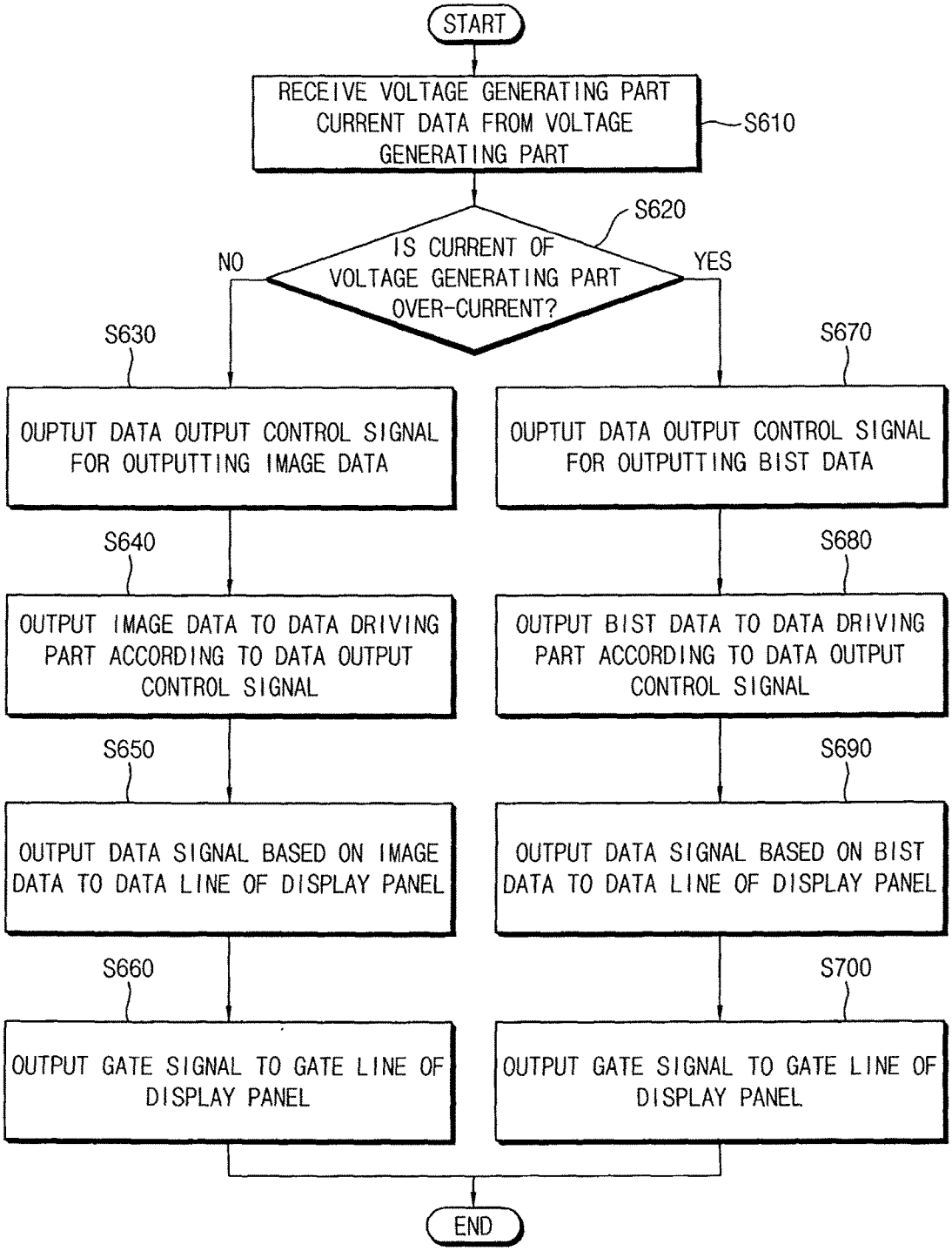
FIG. 18 is a flow chart illustrating a method of driving a display panel, using a display panel driving apparatus of FIG. 16 according to an exemplary embodiment of the present inventive concept.

FIG. 18 is a flow chart illustrating a method of driving a display panel, using the display panel driving apparatus of FIG. 16 according to an exemplary embodiment of the present inventive concept.

Referring to FIGS. 16 to 18, the voltage generating part current data VGCD is received from the voltage generating part 150 (step S610). The voltage generating part state receiving part 1210 receives, from the voltage generating part 150, the voltage generating part current data VGCD indicating the current of the voltage generating part 150, among the pieces of the voltage generating part state data VGSD indicating the state of the voltage generating part 150. For example, the voltage generating part state receiving part 1210 may receive the voltage generating part current data VGCD from the voltage generating part 150 through the Inter-Integrated Circuit (I2C) communication.

It is determined that the current of the voltage generating part 150 is an over-current (step S620). The voltage generating part state receiving part 1210 analyzes the voltage generating part current data VGCD and determines whether the current of the voltage generating part 150 is not less than the reference current.

When the current of the voltage generating part 150 is not the over-current, the data output control signal DATAOC for outputting the image data DATA is output (step S630). The voltage generating part state receiving part 1210 outputs the data output control signal DATAOC for outputting the image data DATA according to the voltage generating part current data VGCD.

The image data DATA is output to the data driving part 740 according to the data output control signal DATAOC (step S640). The data outputting part 1230 outputs the image data DATA to the data driving part 740 according to the data output control signal DATAOC.

The data signal DS based on the image data DATA is output to the data line DL of the display panel 110 (step S650). The data driving part 740 outputs the data signals DS based on the image data DATA provided from the timing controlling part 1200 to the data line DL in response to the horizontal start signal STH and the second clock signal CLK2 provided from the timing controlling part 1200.

The gate signal GS is output to the gate line GL of the display panel 110 (step S660). The gate driving part 130 generates the gate signal GS in response to the vertical start signal STV and the first clock signal CLK1 provided from the timing controlling part 1200, and outputs the gate signal GS to the gate line GL.

When the current of the voltage generating part 150 is the over-current, the data output control signal DATAOC for outputting the BIST data BISTDATA is output (step S670). The voltage generating part state receiving part 1210 outputs the data output control signal DATAOC for outputting the BIST data BISTDATA according to the voltage generating part current data VGCD.

The BIST data BISTDATA is output to the data driving part 740 according to the data output control signal DATAOC (step S680). The data outputting part 1230 outputs the BIST data BISTDATA to the data driving part 740 according to the data output control signal DATAOC.

The data signal DS based on the BIST data BISTDATA is output to the data line DL of the display panel 110 (step S690). The data driving part 740 outputs the data signals DS based on the BIST data BISTDATA provided from the timing controlling part 1200 to the data line DL in response to the horizontal start signal STH and the second clock signal CLK2 provided from the timing controlling part 1200.

The gate signal GS is output to the gate line GL of the display panel 110 (step S700). The gate driving part 130 generates the gate signal GS in response to the vertical start signal STV and the first clock signal CLK1 provided from the timing controlling part 1200, and outputs the gate signal GS to the gate line GL.

In an exemplary embodiment of the present inventive concept, the voltage generating part state receiving part 1210, the BIST data generating part 1220 and the data outputting part 1230 are disposed in the timing controlling part 1200. However, the present inventive concept is not limited thereto. For example, the voltage generating part state receiving part 1210, the BIST data generating part 1220 and the data outputting part 1230 may be located outside the timing controlling part 800.

According to an exemplary embodiment of the present inventive concept, when the current of the voltage generating part 150 is not less than the reference current, the BIST data BISTDATA is output from the timing controlling part 1200 to the data driving part 740 according to the data output control signal DATAOC. Therefore, loads of the timing controlling part 1200, the data driving part 740 and the display panel 110 may be decreased. Thus, damages of the timing controlling part 1200, the data driving part 740 and the display panel 110 may be prevented.

A display panel driving apparatus, a method of driving a display panel using the display panel driving apparatus, and a display apparatus having the display panel driving apparatus, may perform at least one of an operation of changing a Dynamic Capacitance Compensation (DCC) value, an operation of changing an Accurate Color Capture (ACC) compensation value, an operation of stopping a driving of a gate driving part and a driving of a data driving part, and an operation of outputting a Built-In Self Test (BIST) data when a voltage generating part, which generates a voltage used in a driving of a display panel, operates abnormally. Thus, degradation of display quality of a display apparatus may be prevented, and a damage of the display apparatus may be prevented.

While the present inventive concept has been particularly shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A display device comprising:

a display panel configured to display an image and comprising a gate line and a data line;

a gate driving circuit configured to output a gate signal to the gate line of the display panel;

a data driving circuit configured to output a data signal to the data line of the display panel;

a timing controlling circuit configured to control timings of the gate driving circuit and the data driving circuit;

a voltage generating circuit configured to generate a first voltage to drive the display panel; and a voltage generating circuit state receiving circuit configured to receive a voltage generating circuit temperature data indicating a temperature of the voltage generating circuit, a voltage generating circuit voltage data indicating a voltage of the voltage generating circuit, and a voltage generating circuit current data indicating a current of the voltage generating circuit from the voltage generating circuit and control an operation of the timing controlling circuit based on each of the voltage generating circuit temperature data, the voltage generating circuit voltage data, and the voltage generating circuit current data, wherein the voltage generating circuit state receiving circuit outputs a data output control signal for controlling an output data from the timing controlling circuit according to the voltage of the voltage generating circuit, and wherein, when the voltage of the voltage generating circuit is less than a reference voltage, the timing controlling circuit outputs an image data according to the data output control signal, and when the voltage of the voltage generating circuit is not less than the reference voltage, the timing controlling circuit outputs a build in self test data according to the data output control signal.

2. The display device of claim 1, wherein the voltage generating circuit state receiving circuit includes:

a first controller configured to receive the voltage generating circuit temperature data;

a second controller configured to receive the voltage generating circuit voltage data; and a third controller configured to receive the voltage generating circuit current data.

3. The display device of claim 2, wherein the first controller outputs an Accurate Color Capture (ACC) compensation value selection signal for selecting an ACC compensation value according to the voltage generating circuit temperature data.

4. The display device of claim 2, wherein the first controller outputs a Dynamic Capacitance Compensation (DCC) value selection signal for selecting a DCC value according to the voltage generating circuit temperature data.

5. The display device of claim 2, wherein the second controller outputs the ready signal control signal.

6. The display device of claim 5, wherein, when the voltage of the voltage generating circuit is less than a reference voltage, the timing controlling circuit activates the ready signal according to the ready signal control signal, and when the voltage of the voltage generating circuit is not less than the reference voltage, the timing controlling circuit deactivates the ready signal according to the ready signal control signal.

7. The display device of claim 2, wherein the third controller outputs a ready signal control signal for controlling a ready signal of the timing controlling circuit according to the current of the voltage generating circuit.

8. The display device of claim 7, wherein, when the current of the voltage generating circuit is less than a reference current, the timing controlling circuit activates the ready signal according to the ready signal control signal, and when the current of the voltage generating circuit is not less than the reference current, the timing controlling circuit deactivates the ready signal according to the ready signal control signal.

9. The display device of claim 2, wherein the third controller outputs a data output control signal for controlling an output data from the timing controlling circuit according to the current of the voltage generating circuit.

10. The display device of claim 9, wherein, when the current of the voltage generating circuit is less than a reference current, the timing controlling circuit outputs an image data according to the data output control signal, and when the current of the voltage generating circuit is not less than the reference current, the timing controlling circuit outputs a built in self test data according to the data output control signal.

11. A method of driving a display device, the method comprising:

receiving a voltage generating circuit temperature data indicating a temperature of a voltage generating circuit, a voltage generating circuit voltage data indicating a voltage of the voltage generating circuit, and a voltage generating circuit current data indicating a current of the voltage generating circuit, wherein the voltage generating circuit generates a first voltage for driving the display panel;

outputting a timing control circuit control signal for controlling an operation of a timing controlling circuit based on each of the voltage generating circuit temperature data, the voltage generating circuit voltage data, and the voltage generating circuit current data;

operating the timing controlling circuit according to the timing control circuit control signal;

outputting a data signal to a data line of the display panel according to the operation of the timing controlling circuit; and outputting a gate signal to a gate line of the display panel according to the operation of the timing controlling circuit, wherein outputting the timing control circuit control signal comprises outputting a data output control signal for controlling an output data of the timing controlling circuit according to the voltage of the voltage generating circuit, and wherein, when the voltage of the voltage generating circuit is less than a reference voltage, the timing controlling circuit outputs image data according to the data output control signal, and when the voltage of the voltage generating circuit is not less than the reference voltage, the timing controlling circuit outputs built in self test data according to the data output control signal.

12. The method of claim 11, wherein outputting the timing control circuit control signal comprises outputting an Accurate Color Capture (ACC) compensation value selection signal for selecting an ACC compensation value according to the voltage generating circuit temperature data.

13. The method of claim 11, wherein outputting the timing control circuit control signal comprises outputting a Dynamic Capacitance Compensation (DCC) value selection signal for selecting a DCC value according to the voltage generating circuit temperature data.

14. The method of claim 11, wherein outputting the timing control circuit control signal comprises outputting a ready signal control signal for controlling a ready signal of the timing controlling circuit according to the voltage of the voltage generating circuit, and wherein, when the voltage of the voltage generating circuit is less than a reference voltage, the timing controlling circuit activates the ready signal according to the ready signal control signal, and when the voltage of the voltage generating circuit is not less than the reference voltage, the timing controlling circuit deactivates the ready signal according to the ready signal control signal.

15. The method of claim 11, wherein outputting the timing control circuit control signal comprises outputting a ready signal control signal for controlling a ready signal of the timing controlling circuit according to the current of the voltage generating circuit, and wherein, when the current of the voltage generating circuit is less than a reference current, the timing controlling circuit activates the ready signal according to the ready signal control signal, and when the current of the voltage generating circuit is not less than the reference current, the timing controlling circuit deactivates the ready signal according to the ready signal control signal.

16. The method of claim 11, wherein outputting the timing control circuit control signal comprises outputting a data output control signal for controlling an output data of the timing controlling circuit according to the current of the voltage generating circuit, and wherein, when the current of the voltage generating circuit is less than a reference current, the timing controlling circuit outputs an image data according to the data output control signal, and when the current of the voltage generating circuit is not less than the reference current, the timing controlling circuit outputs a built in self test data according to the data output control signal.

* * * * *